US008031073B2

(12) United States Patent
Hogan et al.

(10) Patent No.: US 8,031,073 B2
(45) Date of Patent: Oct. 4, 2011

(54) SECURITY DEVICE FOR A BOTTLE

(75) Inventors: Dennis L. Hogan, Lighthouse Point, FL (US); Paul Griffiths, legal representative, Boynton Beach, FL (US); Gilbert Fernandez, Weston, FL (US); Pedro Lopez, Pompano Beach, FL (US); Dale W. Raymond, Boca Raton, FL (US); Franklin H. Valade, Jr., Fort Walton Beach, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 406 days.

(21) Appl. No.: 11/792,632

(22) PCT Filed: Dec. 7, 2005

(86) PCT No.: PCT/US2005/044688

§ 371 (c)(1),
(2), (4) Date: Sep. 8, 2009

(87) PCT Pub. No.: WO2006/063262

PCT Pub. Date: Jun. 15, 2006

(65) Prior Publication Data

US 2010/0005840 A1 Jan. 14, 2010

Related U.S. Application Data

(60) Provisional application No. 60/683,657, filed on May 23, 2005, provisional application No. 60/633,813, filed on Dec. 7, 2004.

(51) Int. Cl.
*G08B 13/14* (2006.01)

(52) U.S. Cl. ..... 340/572.9; 340/572.8; 340/572.1; 340/571; 24/704.1; 70/57.1

(58) Field of Classification Search ..... 340/572.1, 340/571, 572.8, 572.9; 24/704.1; 70/57.1; 215/201, 212, 279; 292/256, 325; D8/330–332, D8/349; D10/104, 106
See application file for complete search history.

(56) References Cited

U.S. PATENT DOCUMENTS

| | | | | |
|---|---|---|---|---|
| 5,079,540 | A * | 1/1992 | Narlow et al. | 340/572.8 |
| D445,682 | S | 7/2001 | Michael et al. | |
| D445,683 | S | 7/2001 | Michael et al. | |
| D446,118 | S | 8/2001 | Michael et al. | |
| 6,726,033 | B2 * | 4/2004 | Sparkowski et al. | 211/85.3 |
| 6,769,557 | B2 | 8/2004 | Michael et al. | |
| 6,822,567 | B2 * | 11/2004 | Durbin | 340/568.1 |
| D506,694 | S * | 6/2005 | Corney | D10/104 |
| 6,912,878 | B2 * | 7/2005 | Belden, Jr. | 70/57.1 |
| 2002/0003477 | A1 | 1/2002 | Roy, Jr. | |

* cited by examiner

*Primary Examiner* — Davetta W. Goins
*Assistant Examiner* — Hongmin Fan

(57) ABSTRACT

Systems and apparatuses for a security device for a bottle are disclosed.

35 Claims, 18 Drawing Sheets

SECURITY DEVICE FOR A BOTTLE

This application claims priority to the U.S. Provisional Patent Application Ser. No. 60/633,813 titled "Improved EAS Security Tags" filed Dec. 7, 2004, and to the U.S. Provisional Patent Application Ser. No. 60/683,657 titled "Improved EAS Security Tags" filed May 23, 2005, both of which are incorporated herein by reference in their entirety.

RELATED APPLICATIONS

This international application designating the United States of America is related to the following applications designating the United States of America:

(1) "Magnetically Actuable Locking Mechanism And Associated Security Device";

(2) "Optical Disc Security Device Having A Magnetically Actuable Locking Mechanism";

(3) "Security Device For An Article Having A Constrained Elongate Element"; and (4) "Security Device Having A Cable."

These related applications are being filed concurrently herewith and are incorporated by reference in their entirety.

BACKGROUND

A security tag system is designed to prevent unauthorized removal of an item from a controlled area. For example, a typical Electronic Article Surveillance (EAS) system may comprise a monitoring system and one or more security tags. The monitoring system may create a surveillance zone at an access point for the controlled area. A security tag may be enclosed in a security device that is secured to the monitored item, such as an article of hard goods, e.g., sporting equipment, eye wear, jewelry, bottles, and the like. If the monitored item enters the surveillance zone, an alarm may be triggered to indicate unauthorized removal.

The security device may be secured to a number of different items. It may be desirable for the security device to allow authorized release from the article, while making unauthorized release relatively difficult. Consequently, there may be a need for improved techniques in security devices in general, and systems for securing the security devices to articles in particular.

BRIEF DESCRIPTION OF THE DRAWINGS

The subject matter regarded as embodiments is particularly pointed out and distinctly claimed in the concluding portion of the specification. Embodiments, however, both as to organization and method of operation, may best be understood by reference to the following detailed description when read with the accompanying drawings in which:

DETAILED DESCRIPTION

Embodiments may be directed to apparatuses, systems and methods for pairing an article, such as a bottle, for example, with a security tag.

For example, one embodiment may include a security device comprising a locking mechanism, security tag, and a housing. The locking mechanism may comprise a magnetically actuable latch, a flexible element that biases the magnetically actuable latch toward a locking position, and a latch mating element that mates with at least a portion of the magnetically actuable latch in the locking position. As used herein, the "locking position" may refer to the position of the magnetically actuable latch in which it is partially or fully within a void of, in engagement with, joined with, or otherwise mated with the latch mating element. The housing may be a structure configured to partially or fully contain, enclose, or otherwise secure the locking mechanism, security tag, latch mating element, and the article to the housing. As secured, the magnetically actuable latch of the locking mechanism may mate with the latch mating element in the locking position to lock the housing, and thus the security tag with which the housing is secured, to the article. When the housing is locked, the security device may prevent or provide resistance to an attempt to separate the housing from the article. Another embodiment may include a security system comprising the security device and a detacher, which may be a device that includes a magnet. The detacher may be employed to unlock the housing by magnetically forcing the magnetically actuable latch away from the locking position.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

Figure 1:
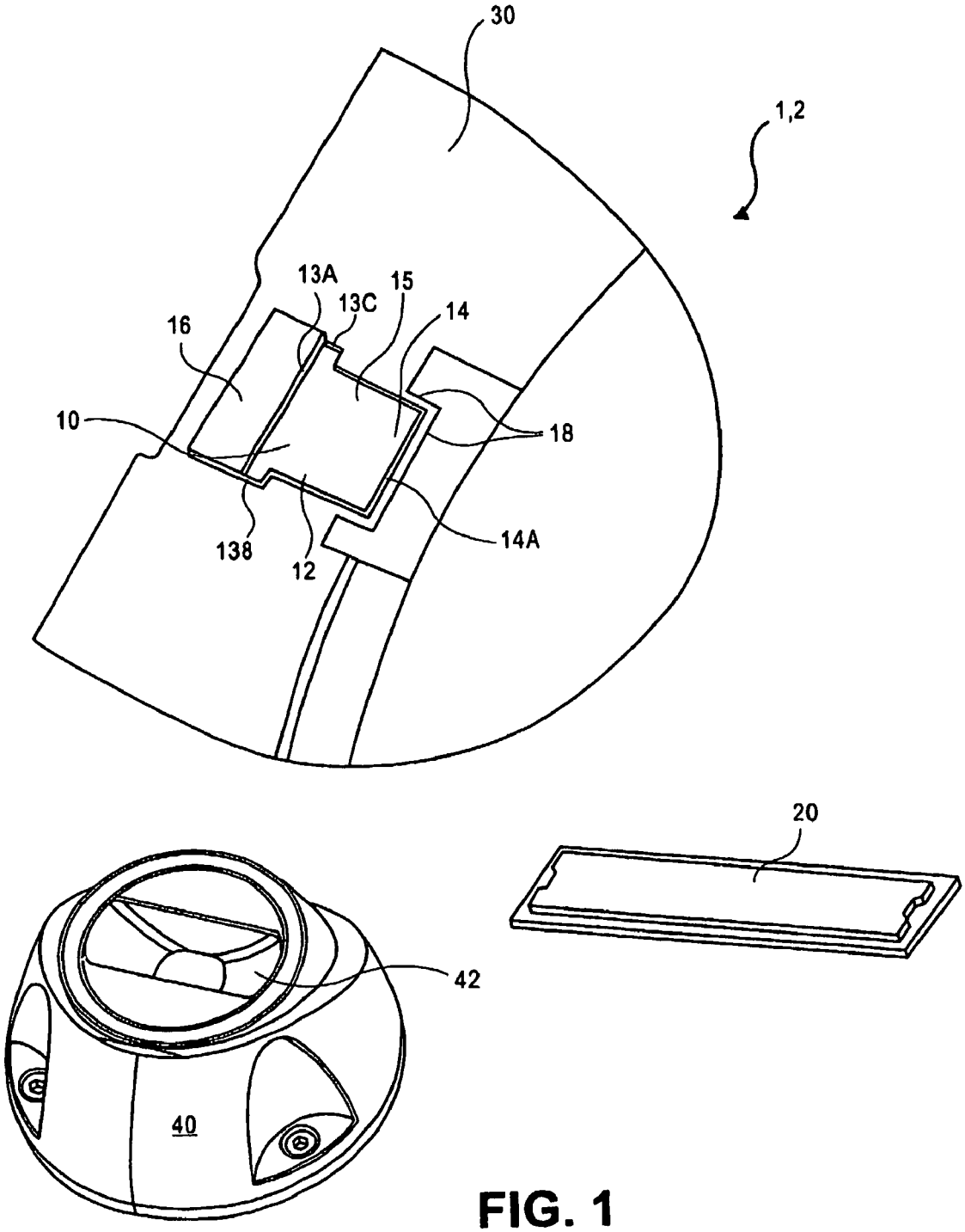
FIG. 1 illustrates components of a security device and system, in accordance with one embodiment.
Figure 1A:
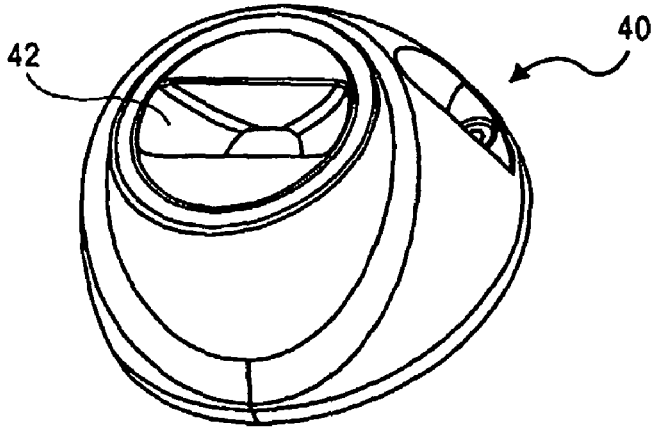
FIG. 1A illustrates a perspective view of a detacher, in accordance with one embodiment.
Figure 1B:
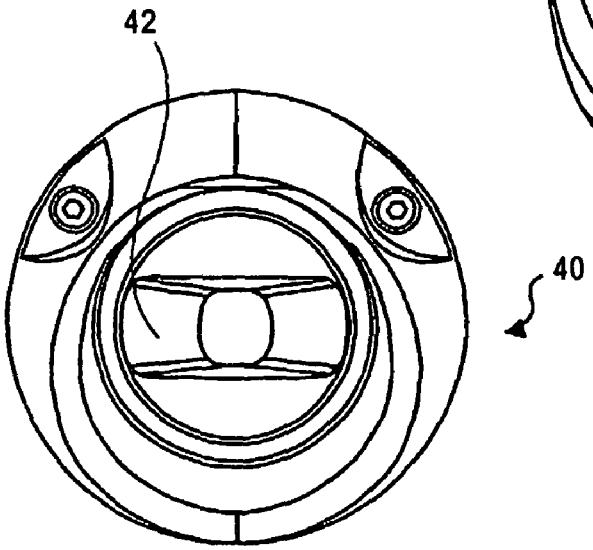
FIG. 1B illustrates a top view of a detacher, in accordance with one embodiment.
Figure 1C:
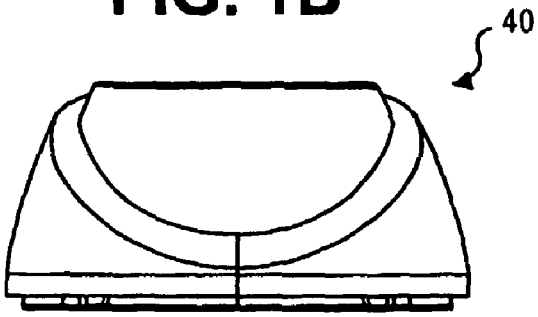
FIG. 1C illustrates a front view of a detacher, in accordance with one embodiment.
Figure 1D:
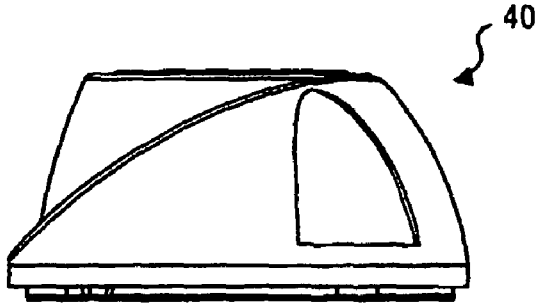
FIG. 1D illustrates a side view of a detacher, in accordance with one embodiment.

Referring now in detail to the drawings wherein like parts are designated by like reference numerals throughout, there is illustrated in FIG. 1 a front view of components that may be included in a security system 1 and a security device 2 in accordance with one embodiment. In this embodiment, the security system 1 includes the security device 2 and a detacher 40. The security device 2 may include a locking mechanism 10, security tag 20, and housing 30.

The locking mechanism 10 may be a magnetically actuable locking mechanism, and may include a magnetically actuable latch 12, flexible element 16, and latch mating element 18.

The magnetically actuable latch 12 may include a base portion 13, which may include a base portion end 13A and side surfaces 13B and 13C; and a latching portion 14, which may include a latching portion end 14A; and a central portion 15.

The magnetically actuable latch 12 may have a substantially rectangular-shaped face such that the base portion 13 has the same width as both the latching portion 14 and central portion 15. Thus, the width of the base portion 13, or the distance between the side surfaces 13B and 13C, may be the same as the corresponding widths of the latching portion 14 and central portion 15. In other embodiments, the widths of the base portion 13, latching portion 14, and central portion 15 may differ. The magnetically actuable latch 12 may have a slender, uniform cross-section.

However, the magnetically actuable latch 12 may be configured as desired, may comprise one or more pieces, and may be symmetrical or unsymmetrical about any point, line, or plane. For example, in various embodiments the magnetically actuable latch 12 may be configured with a "T", "I", curved, or other shape of face and with a rectangular, circular, thick, hollow or otherwise voided, and/or non-uniform cross-section, or as described herein with respect to embodiments of the magnetically actuable latch 1512. In another embodiment, the latching portion end 14A of the magnetically actuable latch 12 may include one or more teeth, ribs, notches, jags, points, curves, voids, or other shapes such as those described herein with respect to embodiments of the magnetically actuable latch 1512, while the base portion end 13A may be flat or another shape. In addition, the base portion end 13A may be continuous or discontinuous. The magnetically actuable latch 1512 may be configured such that at least a portion of it, such as the latching portion 14, may engage, receive, insert into, or otherwise mate with the latch mating element 18, such as described herein.

In one embodiment, a security device 2 includes multiple magnetically actuable latches 12, which may be disposed, possibly each along with another flexible element 16 and latch mating element 18, in the same or different portions of the security device 2. For example, in one embodiment, the multiple magnetically actuable latches 12 may each cooperate with another portion of the security device 2 to lock the portion, such as, for example, a portion securing an article or a portion securing a security tag 20.

The magnetically actuable latch 12 may comprise or may be formed of a magnetic material such as iron, nickel, or cobalt, or an alloy of iron, nickel, or cobalt. In one embodiment, the magnetically actuable latch 12 includes one or more magnetic materials and may also include one or more non-magnetic materials.

The flexible element 16 may be shaped as desired, such as in a cuboid, ellipsoid, coil, or any other shape such as described herein with respect to the embodiments of the flexible elements 1516 and may include one or more pieces, or may be combined or integrally formed with the magnetically actuable latch 12. In one embodiment, the flexible element 16 may be shaped as a cantilever arm, such as, for example, a leaf spring. The flexible element 16 may comprise or may be formed of a flexible material such as a light, porous, semi-rigid, elastic, gaseous, and/or spongy material that may provide a resistant force when compressed and may partially or fully recover its uncompressed shape when the compressive force is removed. For example, in various embodiments, the flexible element 16 may comprise or may be formed of a foam rubber, polymeric foam, ceramic foam, or other foam; a rubber; and/or another material or materials. The flexible element 16 may also or alternatively be configured to provide the resistant force when compressed. For example, in various embodiments the flexible element 16 may be configured as a coil, leaf or other cantilevered arm, or other spring, or other like member, that comprises a metal, polymer, ceramic, and/or another material or materials. The flexible element 16 may have any of various masses.

The latch mating element 18 may be configured as desired, such as with one or more holes or other voids, ribs, teeth, protrusions, or other shapes. The latch mating element 18 may include one or more pieces, and may be separate from or integral with the housing 30, such as described herein. The latch mating element 18 may be configured to engage, receive, insert into, or otherwise mate with at least a portion of the magnetically actuable latch 12. For example, in an embodiment where the magnetically actuable latch 12 is a slender member with a rectangular shape of face, the latch mating element 18 may be configured with a void in which the latching portion 14 of the magnetically actuable latch 12 or a part thereof may be inserted into the locking position, as described herein. In an embodiment where the magnetically actuable latch 12 is toothed at its latching portion end 14A, the latch mating element 18 may be configured with ribs that engage the teeth in the locking position.

The security tag 20 may be any detectable device or system, such as any security tag or label. For example, in various embodiments the security tag 20 may be any type of EAS tag (e.g., Radio Frequency (RF) tag, acousto-magnetic tag, and/or combinations thereof), Radio Frequency Identification (RFID) tag, smart tag, or other detectable anti-theft or other tag. The security tag 20 may be detectable by a corresponding detecting system or device, such as, depending on the type of security tag or label, an acousto-magnetic detector, electromagnetic detector, radio frequency detector, or other detector.

The housing 30, as partially shown in the embodiment of FIG. 1, may be any casing or other structure that partially or fully contains and/or surrounds, encloses, affixes to, interlocks with, or otherwise secures the locking mechanism 10 and security tag 20, and, when the locking mechanism 10 is in the locking position and the housing is thereby locked, an article. The housing 30 and locking mechanism 10 may thus cooperate to secure, or lock, the article to the housing 30, and thus the security device 2. The housing 30 may be configured as desired, and may be shaped based upon the shapes of the locking mechanism 10, security tag 20, and article for which it is designed to secure, such as described herein with respect to the embodiments of the housings 1530 and 1730. The housing 30 may include the latch mating element 18, which may be integral with the housing 30. The housing 30 may alternatively be configured to pair with the latch mating element 18. The housing 30 may comprise a polymer and/or another material or materials.

The components included in the security device 2 may be configured such that the security device 2 may lock to an article, such as described with respect to the security device embodiments below. The security tag 2 may be reusable or may be for one-time use.

FIGS. 1A-1D illustrate a perspective, top, front, and side view of the detacher 40 shown in FIG. 1, in accordance with one embodiment. The detacher 40 may be a device that includes and houses a magnet 42. The magnet 42 may be any type of magnet, such as any permanent magnet or electromagnet, for example. Regarding the security system 1, the detacher 40 may be employed with the security device 2 to unlock the security device 2 from an article. The detacher 40 may be positioned appropriately near the magnetically actuable latch 12 of the security device 2 to magnetically force the magnetically actuable latch 12 away from the locking position, thus allowing the housing 30 of the security device 2 to be removed from an article to which it may be locked.

In various embodiments, the detacher 40 may include different magnets 42. For example, the magnet 42 of the detacher 40 may be selected based upon the magnetic force needed to move the magnetically actuable latch 12 away from the locking position, thus unlocking the security device 2. This magnetic force may need to more than offset the forces opposing the movement. Such opposing forces may include, for example, the resistant force provided by the flexible element 16 when it is compressed by the magnetically actuable latch 12, frictional forces caused by the magnetically actuable latch 12 contacting the housing 30 and/or another element during movement, and other forces. In another embodiment, where a detacher 40 is intended to be used on various security devices having different configurations, a magnet 42 may be selected that is strong enough to unlock the security device requiring the strongest magnet to unlock it.

Figure 1E:
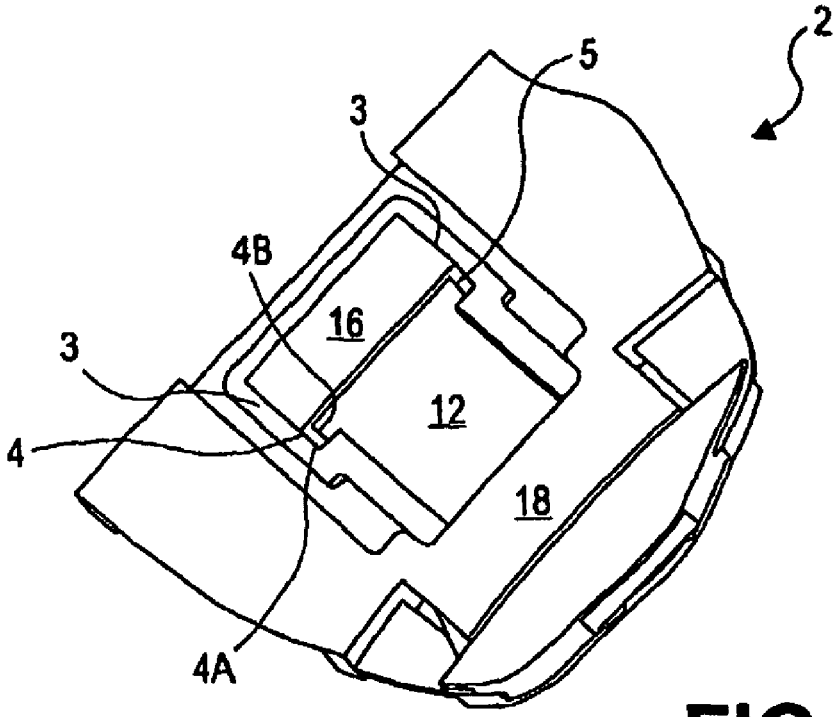
FIG. 1E illustrates a perspective view of a portion of a security device configured for one-time use.
Figure 1F:
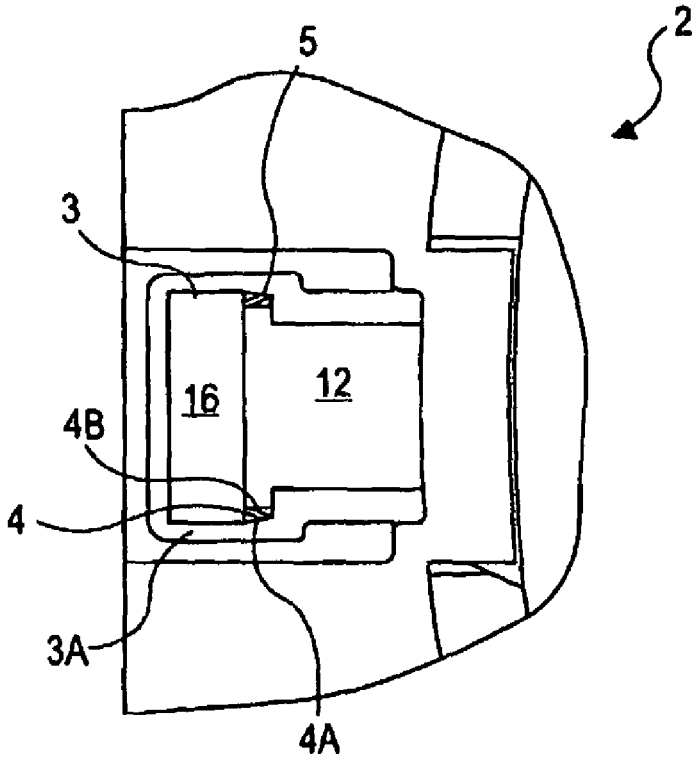
FIG. 1F illustrates a top view of portion of a security device configured for one-time use.
Figure 1G:
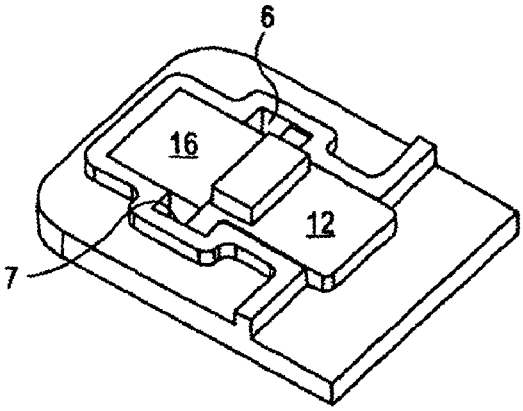
FIG. 1G illustrates a perspective view of a portion of a security device configured to be resettable.
Figure 1H:
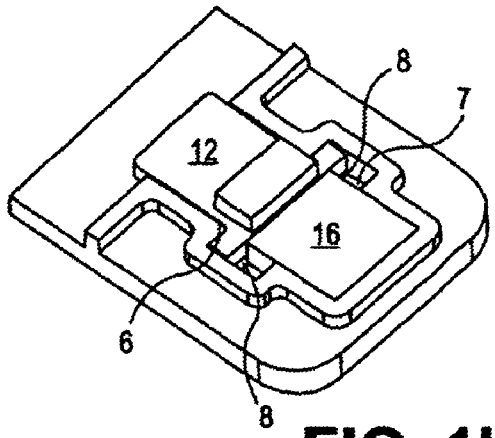
FIG. 1H illustrates a perspective view of a portion of a security device configured for one-time use.
Figure 1I:
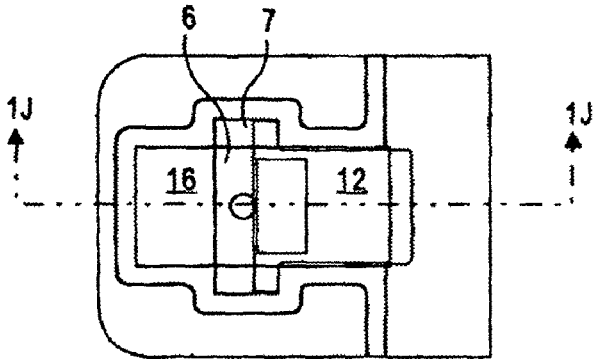
FIG. 1I illustrates a top view of a portion of a security device configured for one-time use.
Figure 1J:
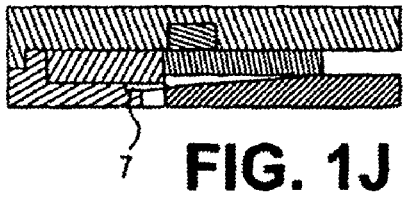
FIG. 1J illustrates a front view of a portion of a security device configured for one-time use.
Figure 2:
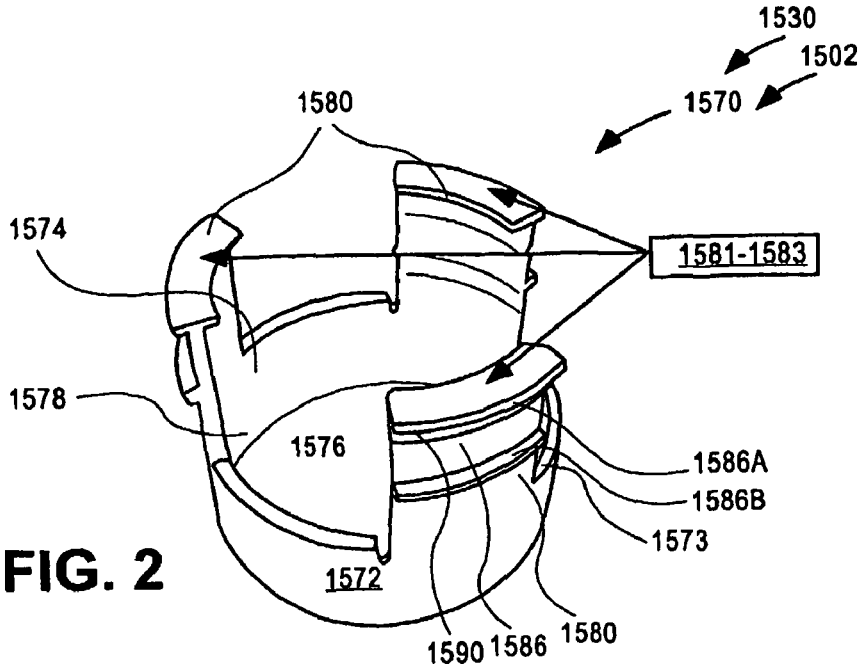
FIG. 2 illustrates a perspective view of a bottle cover, in accordance with one embodiment.
Figure 3:
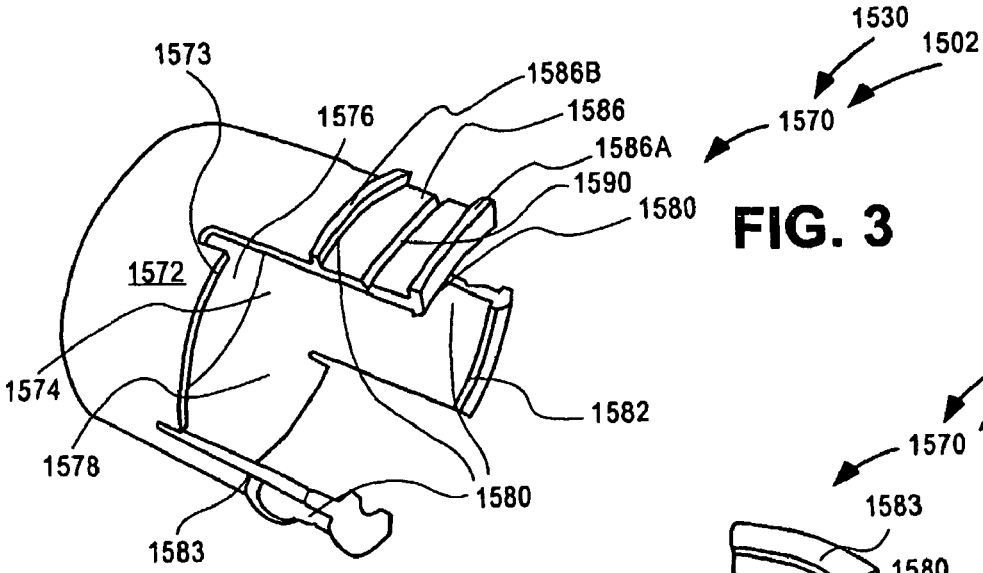
FIG. 3 illustrates a perspective view of a bottle cover, in accordance with one embodiment.
Figure 4:
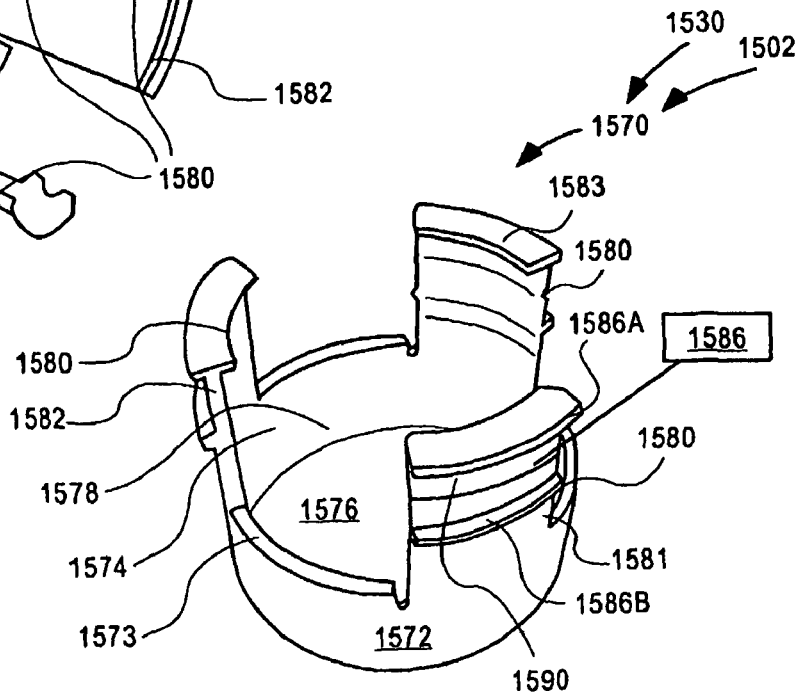
FIG. 4 illustrates a perspective view of a bottle cover, in accordance with one embodiment.
Figure 5:
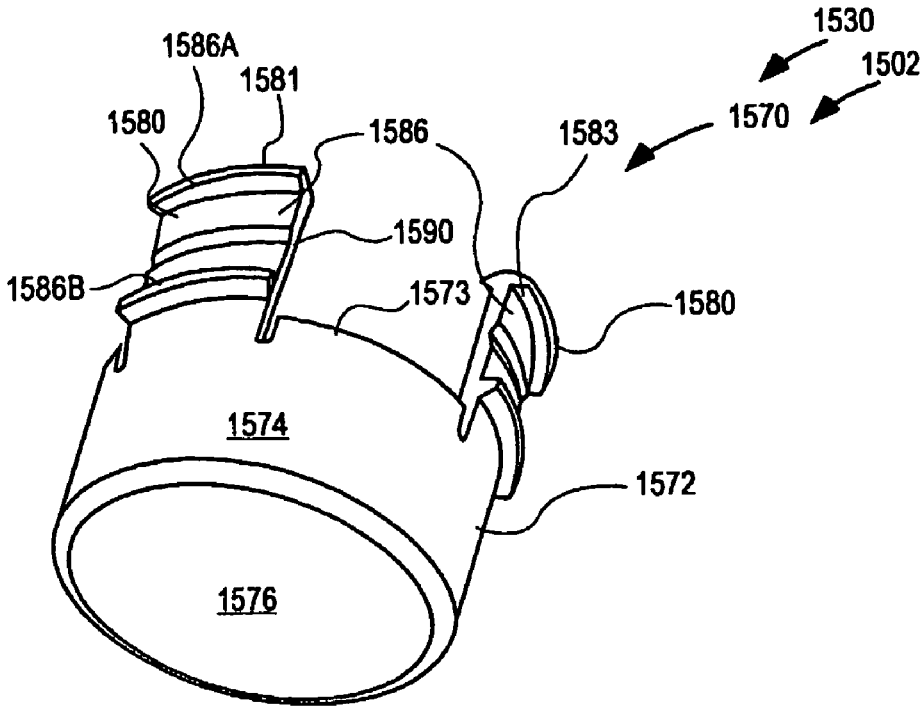
FIG. 5 illustrates a perspective view of a bottle cover, in accordance with one embodiment.
Figure 6:
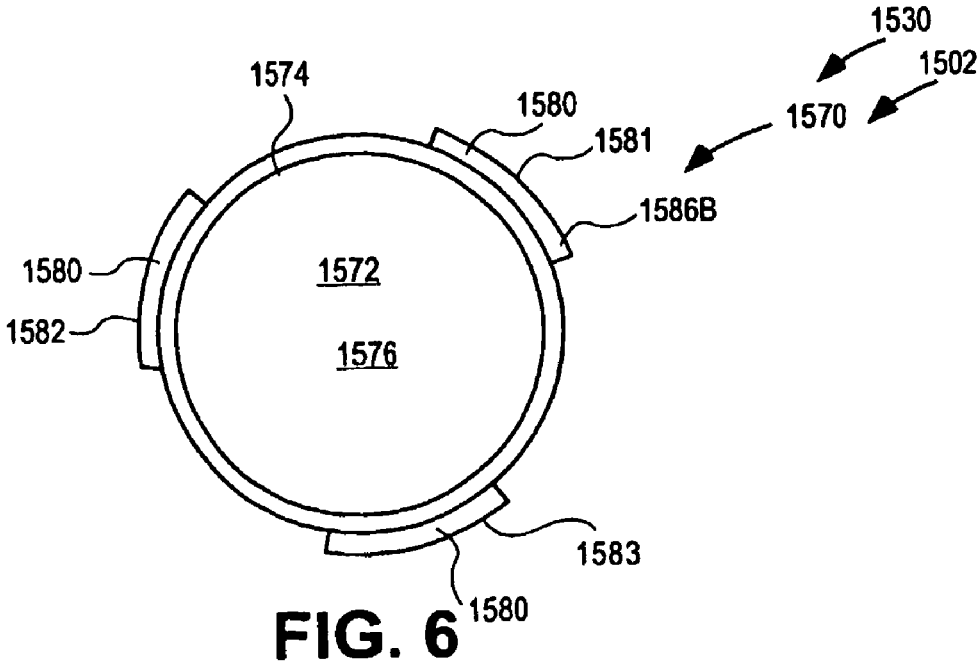
FIG. 6 illustrates a top view of a bottle cover, in accordance with one embodiment.
Figure 7:
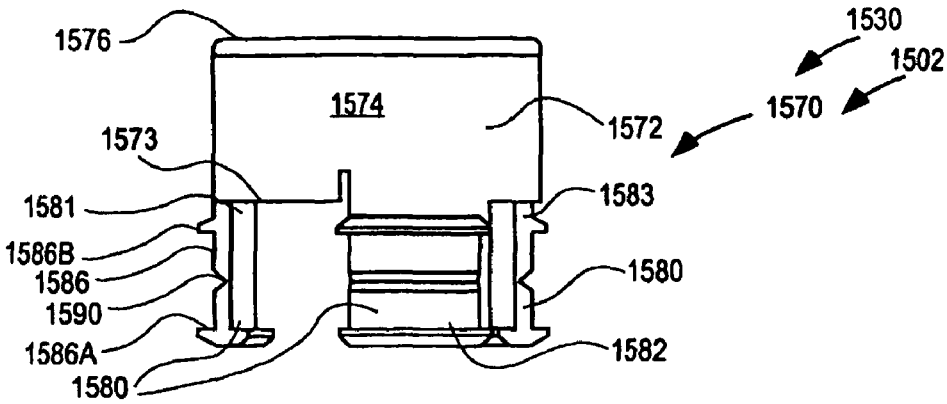
FIG. 7 illustrates a front view of a bottle cover, in accordance with one embodiment.
Figure 8:
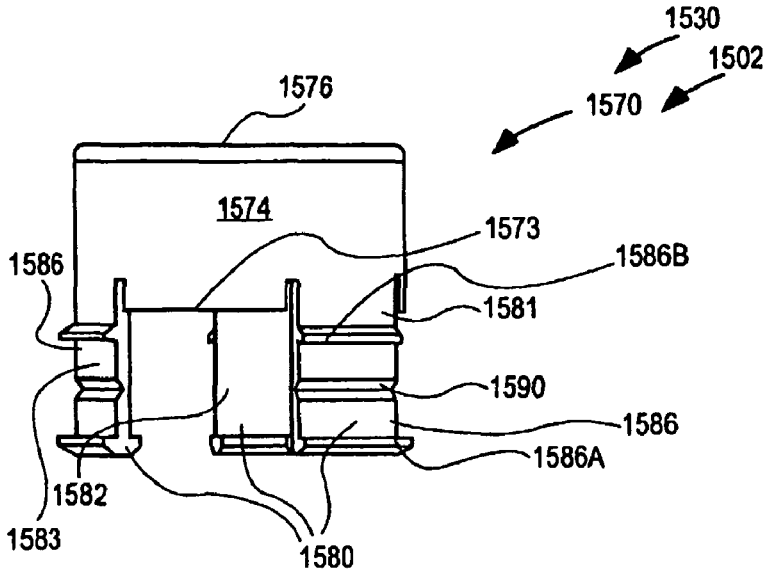
FIG. 8 illustrates a side view of a bottle cover, in accordance with one embodiment.
Figure 9:
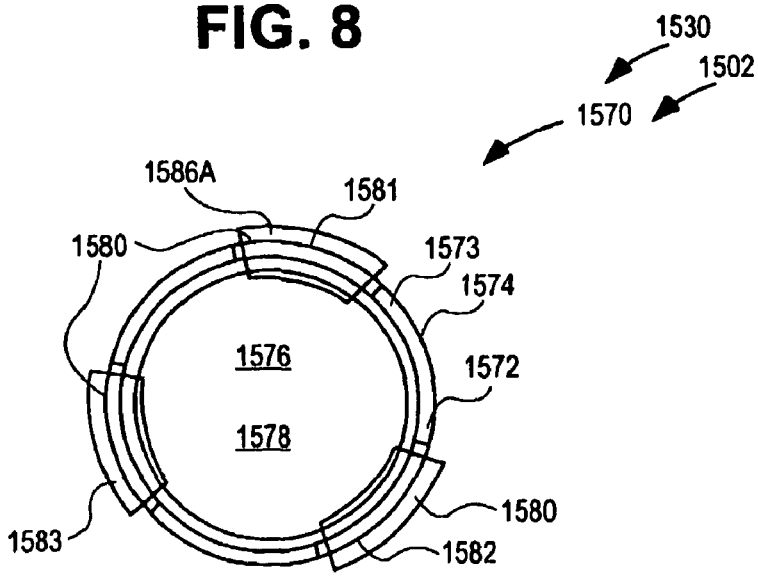
FIG. 9 illustrates a bottom view of a bottle cover, in accordance with one embodiment.

In one embodiment, the security device 2 may be configured for one-time use. For example, in one embodiment as shown in FIGS. 1E-1F, the magnetically actuable latch 12 of the security device 2 may be positioned within a channel 3 as mated with the latch mating element 18 in the locking position. One or more leaf springs or other cantilevered arms, such as the cantilevered arms 4 and 5, are disposed in the channel 3 in a spring-loaded configuration.

For example, the cantilevered arm 4 may have an unloaded position as shown in FIG. 1E. The cantilevered arm may be bent to a position with its side 4A adjacent the channel wall 3A, and thus spring-loaded. The magnetically actuable latch 12 may then be disposed in the channel 3 in the locking position adjacent its other side 4B, preventing the cantilevered arm 4 from moving and preserving its spring load. The cantilevered arm 5 may be similarly positioned. Where the magnetically actuable latch 12 is then moved out of the locking position by the detacher 40, the cantilevered arms 4 and 5 may no longer be constrained by the magnetically actuable latch 12 and may spring back or otherwise return to their unloaded positions. Where in these positions the cantilevered arms 4 and 5 extend into the channel 3 such that they may block the base portion 13 of the magnetically actuable latch 12 from moving past them, the magnetically actuable latch 12 may not be able to return to the locking position. Thus, any appended security device may no longer be able to lock.

In another embodiment, only one of the cantilevered arms 4 and 5 is included. In various other embodiments, other resilient elements, such as coils or other springs, rubbers, and foams, for example, may be employed within the channel 3 or other portion of the housing to prevent the appended security device from being used twice.

In another embodiment such as shown in FIGS. 1G-1J, the locking mechanism 10 and housing 30 may be configured such that after each instance the magnetically actuable latch 12 is moved out of the locking position, the magnetically actuable latch 12 may need to be reset to enable it to be repositioned in the locking position. For example, the magnetically actuable latch 12 may be disposed in a channel 6 with its base end 13A adjacent a recess 7. The recess 7 may be configured such that where the magnetically actuable latch 12 is biased out of the locking position, at least a portion of the magnetically actuable latch 12 falls or is otherwise urged into the recess 7. The recess may be delineated by a wall 8 that may restrict movement of the magnetically actuable latch 12 back toward the locking position. In this embodiment, the security device in which the magnetically actuable latch 12 is disposed may be "reset" for use, such as by employing a magnet that may move the magnetically actuable latch 12 out of the recess.

In another embodiment, a bottle security device 1502, such as described with respect to the embodiments of FIGS. 2-14, may include a bottle hat 1570 and a belt assembly 1550 that may be separate elements.

FIGS. 2-5 illustrate perspective views of a bottle hat 1570, in accordance with one embodiment, and may be referred to where a corresponding element is discussed. The bottle hat 1570 may be shaped and sized to fit over at least a portion of a bottle, such as a wine, liquor, beer, perfume, cosmetic, or any other bottle, or any other container having a protruding neck-like structure with a mouth or other opening at its end. The bottle hat 1570 may include a cup 1572. The cup 1572 may be bounded by a side wall 1574 and a base 1576, which together may delineate a cup opening 1578. In one embodiment, the side wall 1574 is cylindrical and the top wall 1576 is transversely positioned adjacent the side wall 1574, delineating a cup opening 1578 having a substantially cylindrical shape.

However, in other embodiments, the side wall 1574 and base 1576 may be variously shaped and dimensioned, or the cup 1572 may have any other configuration sized to receive and contain at least a bottle mouth and any adjacent cap, cork, or other covering of the bottle mouth, or another element shaped like the bottle mouth and any adjacent covering. For example, in one embodiment, the cup 172 may not include a base 1576, such as where the cup is dome shaped, for example. The cup 1572 may be further configured to contain some or all of any adjacent neck of the bottle through which its enclosed liquid may be released.

The bottle hat 1570 may also contain a receiving structure 1580 configured for receiving the belt assembly 1550. The receiving structure 1580 may extend from a lid 1573 of the cup 1572 opposite the end in which the base 1576 is positioned. In one embodiment, this receiving structure 1580 includes one or more legs. In one embodiment, this receiving structure 1580 includes three legs 1581-1583 that extend from the lid 1573 and are sized and shaped to be disposed around at least a portion of the neck of a bottle. The legs 1581-1583 may have a similar structure and similarly extend from the cup 1572, and so only the leg 1581 is discussed herein. However, one or more of the legs 1581-1583 may be differently configured or absent in various embodiments. In another embodiment, a continuous structure or any other structure that may receive the belt assembly 1550 may substitute for the one or more legs 1581-1583.

The leg 1581 may form an extended portion of the side wall such that it has an arcuate shape. In an embodiment where the side wall 1574 is cylindrical, the leg 1581 may arc about a central axis of the side wall 1574 such that it has a similar or substantially the same radius with respect to the central axis as that of the side wall 1574.

The leg 1581 may include a belt receiving channel 1586 having belt receiving channel walls 1586A and 1586B that may, in one embodiment, extend annularly from the central axis of the side wall 1574.

The belt receiving channel 1586 may include a groove 1590 in the belt receiving channel 1586, into which the belt assembly 1550 may at least partially extend, such as described below. The groove 1590 may extend along the belt receiving channel 1586 and may, in one embodiment, so extend such that it is equally spaced from the belt receiving channel walls 1586A and 1586B. In one embodiment, the groove has a "V" shape. In various other embodiments, the groove 1590 may have a different shape and positioning, and may be shaped and positioned to receive at least a portion of the belt assembly 1550, such as discussed below.

The bottle hat 1570 may be made of plastic or any other material or combination of materials. In one embodiment, the bottle hat 1570 comprises a rugged plastic. In another embodiment, the bottle hat may comprise an elastic material, such as a rubber, for example, or another material that may conform to the shape of the bottle neck or deform to fit around the bottle neck.

FIGS. 6-9 illustrate a top, front, side, and bottom view of the bottle hat 1570, in accordance with one embodiment. As shown, in an embodiment where the side wall 1574 of the bottle hat 1570 is cylindrical, the legs 1581-1583, if included, may have the same internal radius as that of the side wall 1574.

FIGS. 10-14 illustrate perspective views of a belt assembly 1550 or portion thereof, in accordance with one embodiment. The belt assembly 1550 may include a locking mechanism 1510, a security tag 1520, a housing 1530, and a security belt 1560.

The locking mechanism 1510 may include a magnetically actuable latch 1512, a flexible element 1516, and a latch mating element 1518, such as described below.

Figure 12:
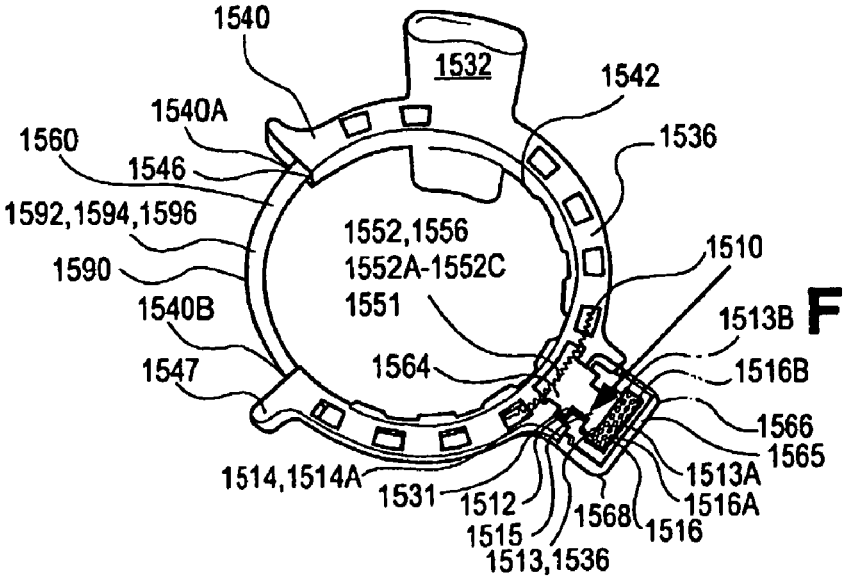
FIG. 12 illustrates a perspective view of a portion of a belt assembly, in accordance with one embodiment.
Figure 14:
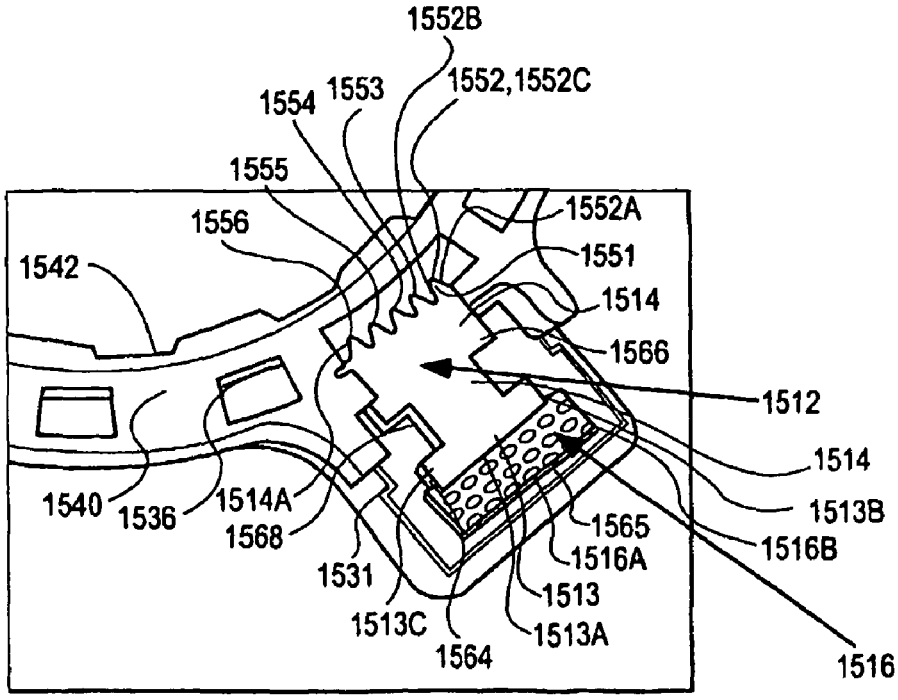
FIG. 14 illustrates a portion of a belt assembly including a magnetically actuable latch and a flexible element, in accordance with one embodiment.
Figure 15:
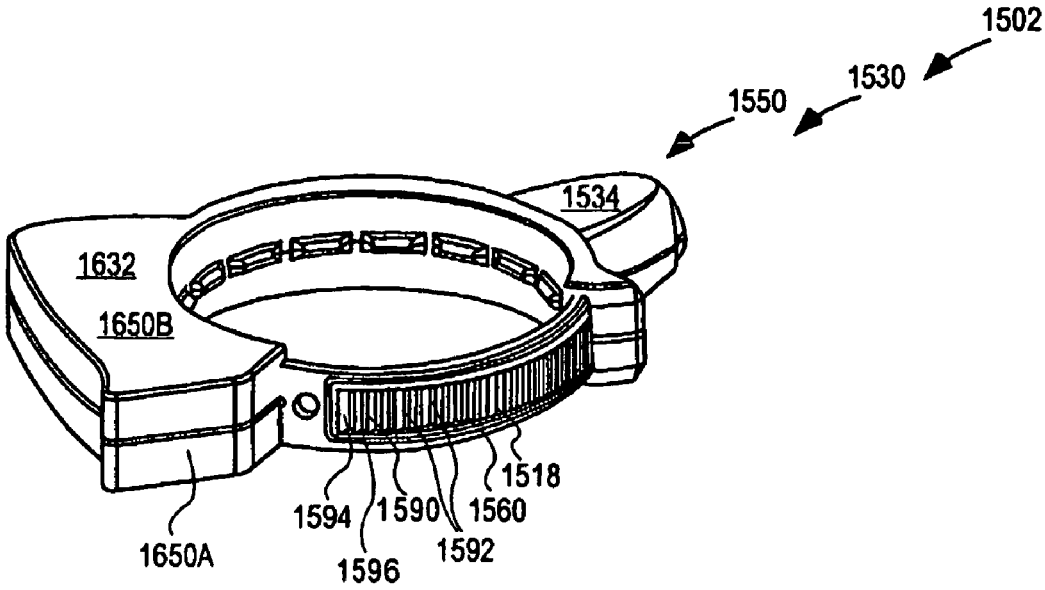
FIG. 15 illustrates a perspective view of a belt assembly, in accordance with one embodiment.
Figure 16:
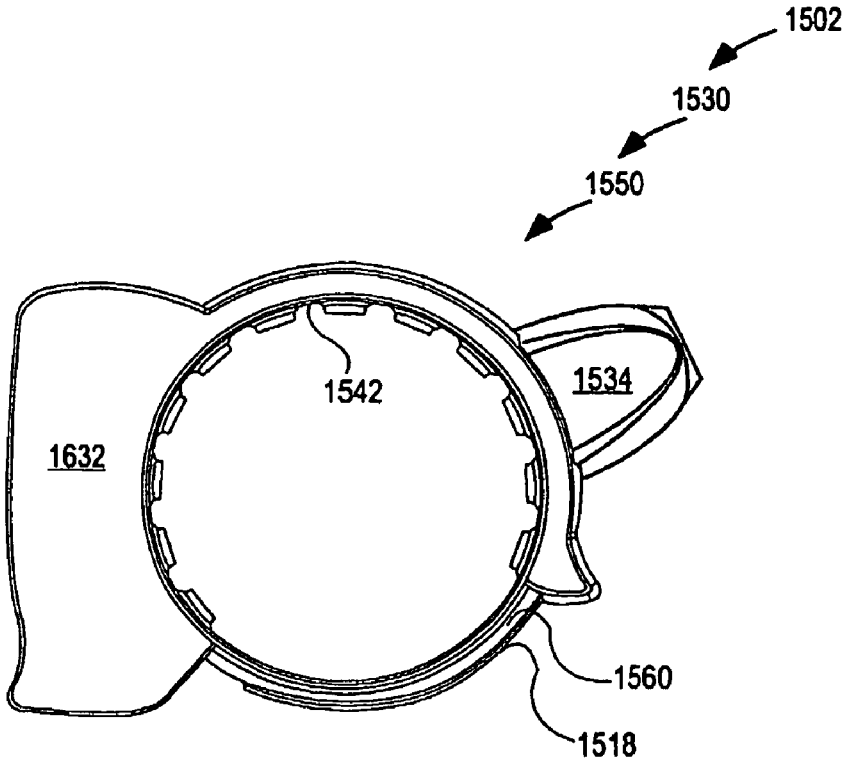
FIG. 16 illustrates a top view of a belt assembly, in accordance with one embodiment.
Figure 17:
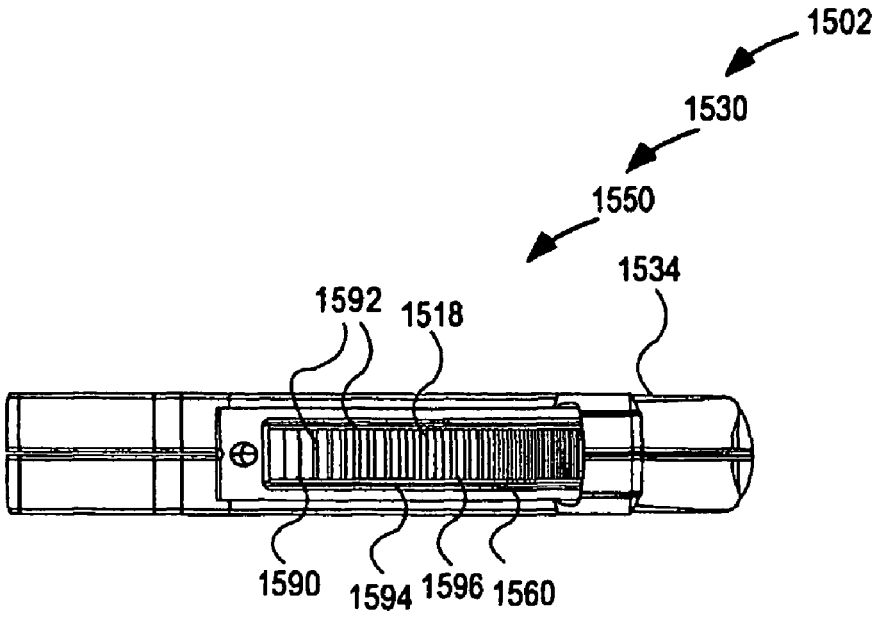
FIG. 17 illustrates a front view of a belt assembly, in accordance with one embodiment.
Figure 18:
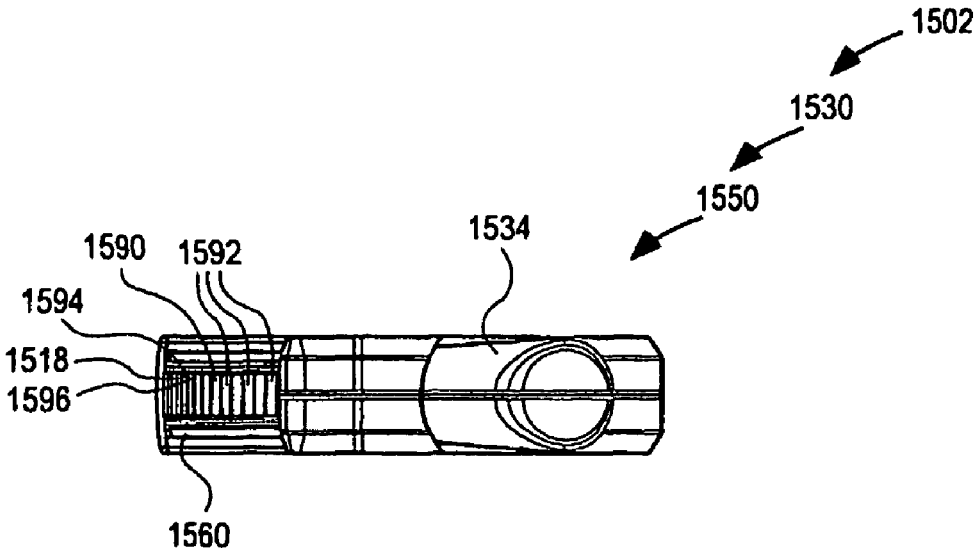
FIG. 18 illustrates a side view of a belt assembly, in accordance with one embodiment.

Reference is first made to FIGS. 12 and 14. FIG. 12 illustrates a perspective view of the belt assembly 1550 showing the magnetically actuable locking mechanism 1512 and the flexible element 1516 of the locking mechanism 1510 disposed in the locking mechanism pouch 1531, in accordance with one embodiment. FIG. 14 illustrates a perspective view of a portion of the housing including the magnetically actuable locking mechanism 1512 and the flexible element 1516, in accordance with one embodiment.

Referring to FIGS. 12 and 14, the magnetically actuable latch 1512 may comprise a magnetic material, and may comprise one or more materials, such as described with respect to the magnetically actuable latch 12 of FIG. 1. The magnetically actuable latch 1512 may include a base portion 1513, which may include a base portion end 1513A and base portion side surfaces 1513B and 1513C; a latching portion 1514, which may include a latching portion end 1514A; and a central portion 1515.

The magnetically actuable latch 1512 may be shaped at least partially like an "I" or a "T" or any other shape. Thus, the base portion side surfaces 1513B and 1513C may be parallel and each may be at least substantially straight. The width of the base portion 1513, which may be the distance between base portion side surfaces 1513B and 1513C, may be wider than the corresponding width of the central portion 1515 but similar to the corresponding width of the latching portion 1514. The base portion end 1513A may be flat and may be substantially perpendicular to the base portion side surfaces 1513B and 1513C. The magnetically actuable latch 1512 may be configured with a slender thickness.

The magnetically actuable latch 1512 may include one or more protrusions 1551. The one or more protrusions 1551 may be positioned at least partially in the latch portion 1514 of the magnetically actuable latch 1512, and may have ends at the latching portion end 1514A.

Figure 19:
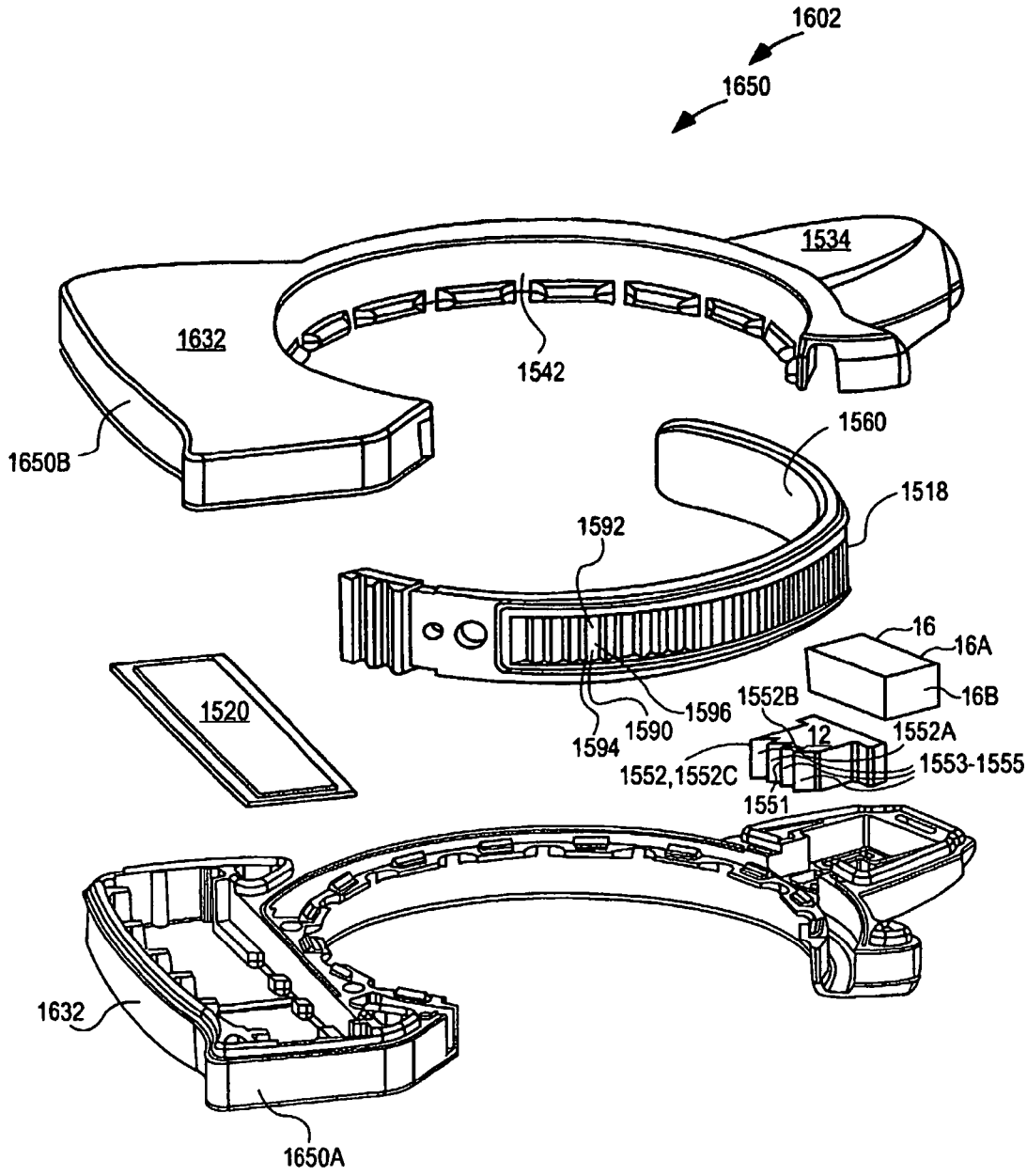
FIG. 19 illustrates an exploded view of a belt assembly, in accordance with one embodiment.
Figure 20:
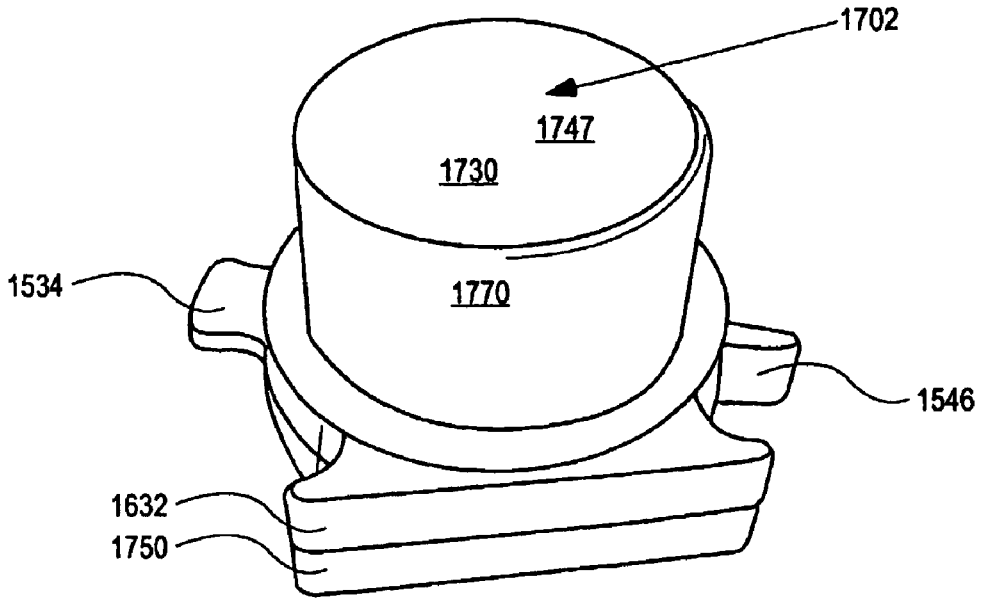
FIG. 20 illustrates a perspective view of a bottle security device, in accordance with one embodiment.
Figure 21:
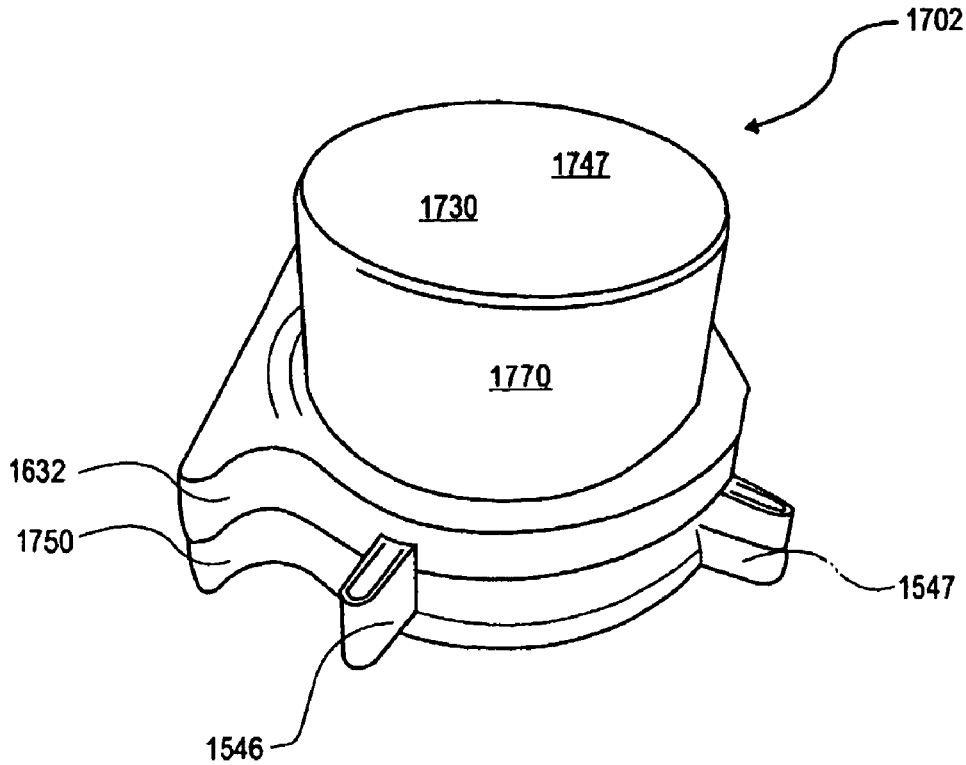
FIG. 21 illustrates a perspective view of a bottle security device, in accordance with one embodiment.
Figure 22:
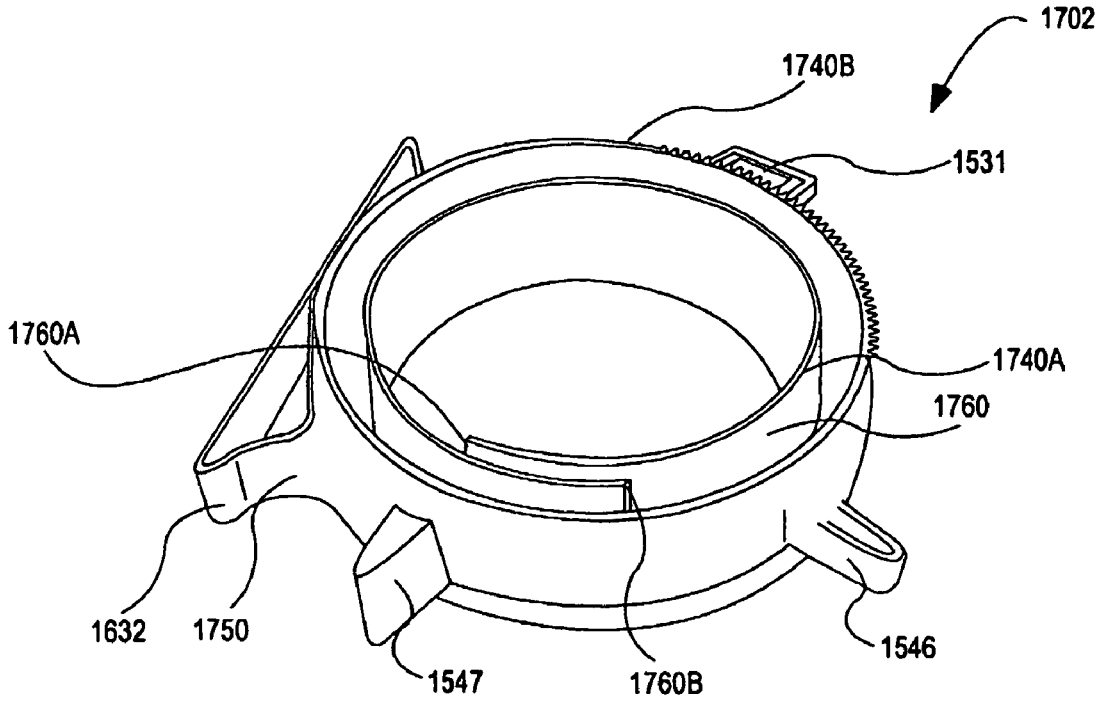
FIG. 22 illustrates a perspective view of a bottom portion of a bottle security device, in accordance with one embodiment.
Figure 23:
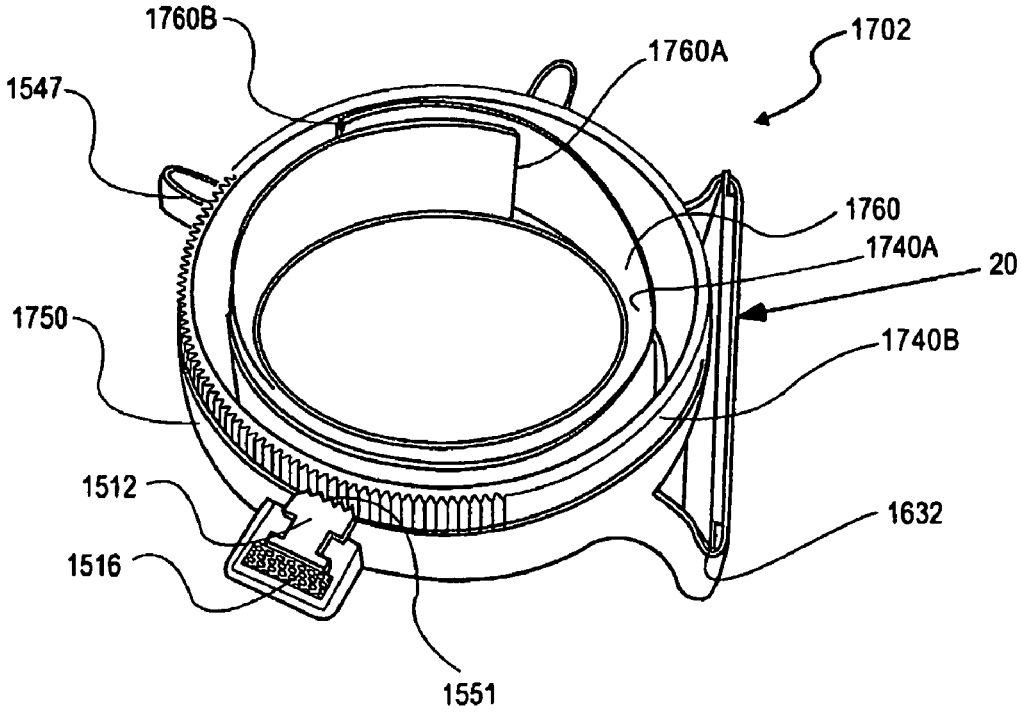
FIG. 23 illustrates a perspective view of a bottom portion of a bottle security device, in accordance with one embodiment.
Figure 24:
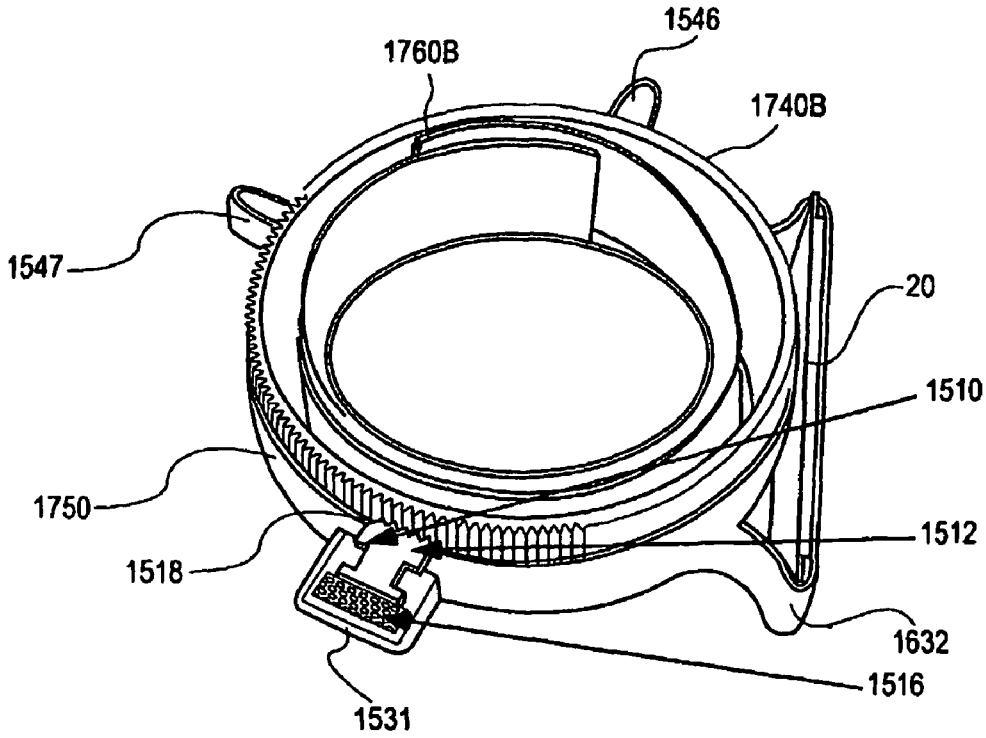
FIG. 24 illustrates a perspective view of a bottom portion of a bottle security device, in accordance with one embodiment.
Figure 25:
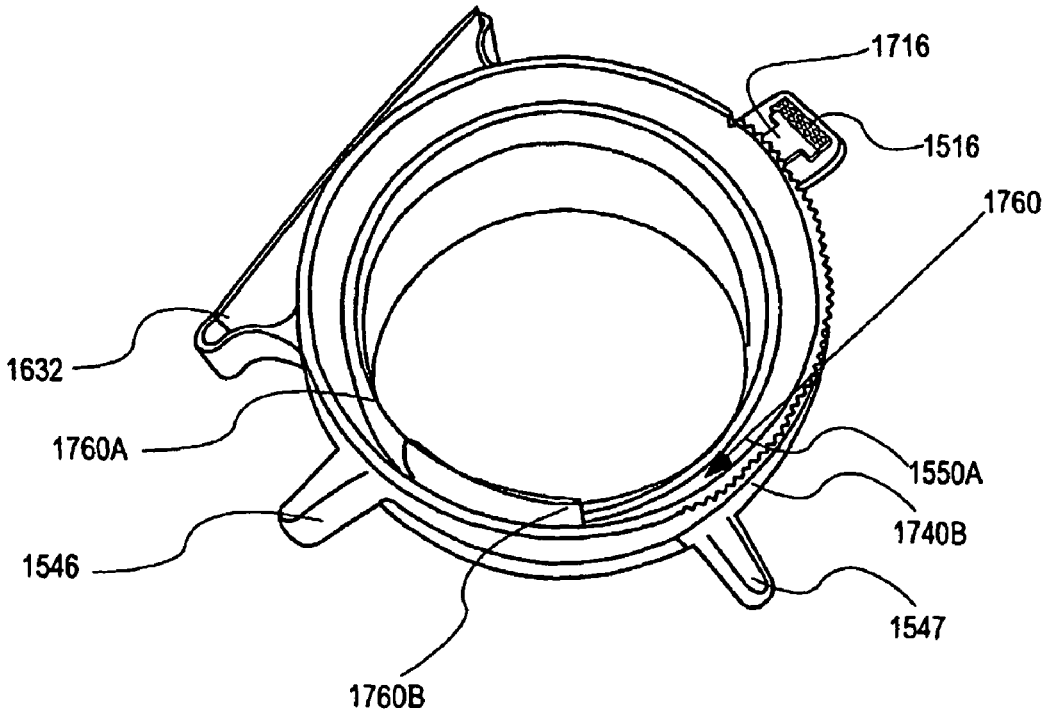
FIG. 25 illustrates a perspective view of a bottom portion of a bottle security device, in accordance with one embodiment.
Figure 26:
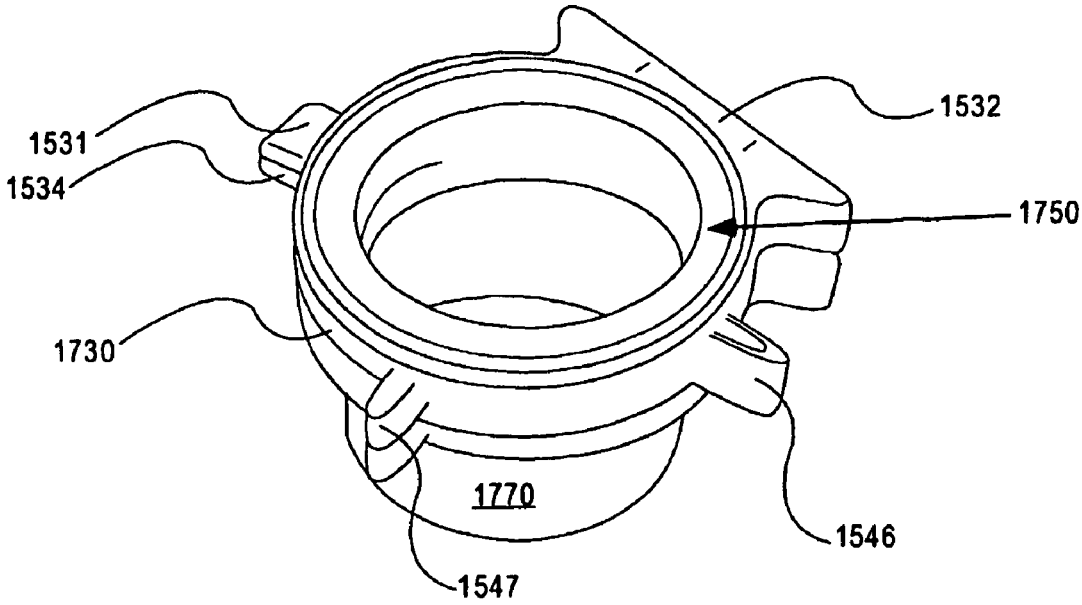
FIG. 26 illustrates a perspective view of a bottle security device, in accordance with one embodiment.
Figure 27:
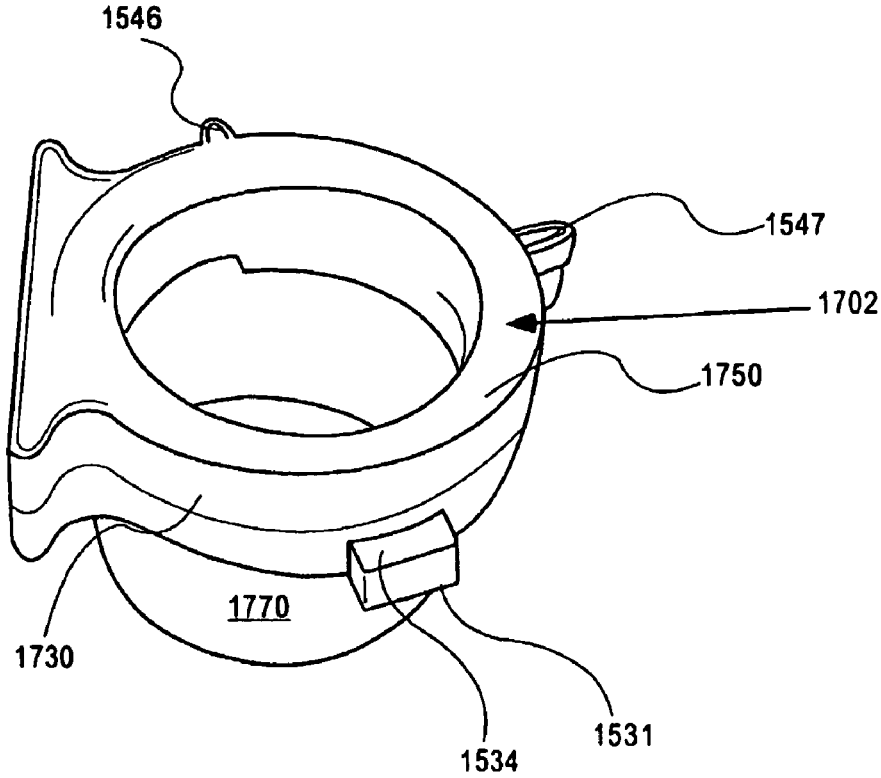
FIG. 27 illustrates a perspective view of a bottle security device, in accordance with one embodiment.
Figure 28:
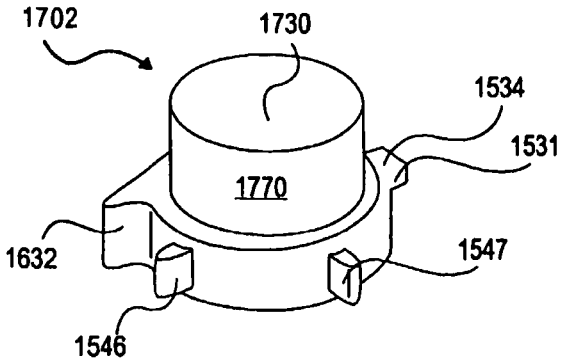
FIG. 28 illustrates a perspective view of a bottle security device, in accordance with one embodiment.
Figure 30:
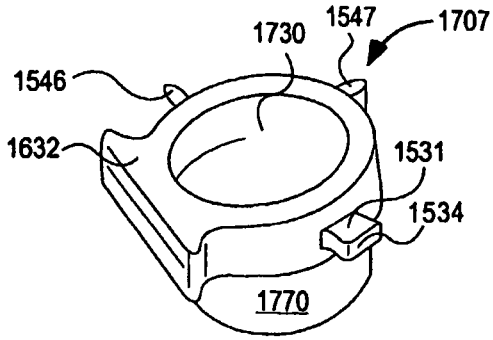
FIG. 30 illustrates a perspective view of a bottle security device, in accordance with one embodiment.

In one embodiment, the one or more protrusions 1551 may include one or more teeth. In one embodiment, for example, the protrusions 1551 may include five teeth 1552-1556 in one embodiment. The one or more teeth may also be viewed in the embodiment of FIG. 19. In this embodiment, the teeth 1552-1556 may have a similar structure and be similarly aligned in the magnetically actuable latch 1512. Therefore, only the tooth 1552 is discussed in detail below. However, one or more of the teeth 1552 may be differently configured or absent in various embodiments.

The tooth 1552 may have sides 1552A and 1552B that may be relatively angled such that they meet at, or terminate near, the tooth end 1552C. The tooth end 1552C may thus be pointed.

The side 1552A may be at least substantially parallel to corresponding sides of teeth 1553-1556, as may be the side 1552B and the corresponding sides of 1553-1556. The side 1552A may be angled with respect to the base portion side surfaces 1513B-1513C of the base portion 1513 and/or the one or both of the corresponding sides of the latching portion 1514 and central portion 1515 of the magnetically actuable latch 1512. The side 1552B may be substantially perpendicular or less angled (than the side 1552A) with respect to the base portion side surfaces 1513B-1513C of the base portion 1513 and the corresponding sides of the latching portion 1514 and central portion 1515. The teeth 1552-1556 may be equally spaced or non-uniformly spaced. In one embodiment, the angles in the tooth sides 1552A and 1552B may vary in different teeth, or any combination of angles may be used.

However, the one or more protrusions 1551 may comprise other configurations. For example, the one or more protrusions 1551 may comprise one or more ribs, notches, jags, points, curves, or voids, for example. The one or more protrusions 1551 may be positioned at least partially on the latching portion 1514 of the latch and may comprise the latching portion end 1514A. The one or more protrusions 1551 may be configured to mate with the latch mating element 1518 in the locking position, such as described below.

The magnetically actuable latch 1512 may be otherwise configured in various embodiments, such as described herein with respect to the magnetically actuable latch 12 shown in FIG. 1.

The flexible element 1516 may comprise or be formed of a flexible material, and may include a material or materials such as described herein with respect to the flexible element 16 shown in FIG. 1. The flexible element 1516, in one embodiment, may be configured with a substantially cuboidal shape such that its side 1516A is wider than its side 1516B, or may have another shape. In various other embodiments, the flexible element 1516 may be configured as, and comprise one or more materials of, a coil or other spring or like member, such as described above with respect to the magnetically actuable latch 12 of FIG. 1.

The latch mating element 1518 may be included in the security belt 1560, and may be separate from or integral with the housing 1530. The latch mating element 1518 may extend along the security belt 1560, such as described herein. In one embodiment, the latch mating element 1518 may include one or more voids 1590. In one embodiment, the magnetically actuable latch 1512 may mate with the latch mating element 1518 in the locking position when the one or more teeth or other protrusions 1551 extend into the one or more voids 1590.

The one or more voids 1590 may be delineated by one or more juts 1592, which may be protrusions such as described herein with respect to the protrusions 1551. The juts 1592 may also be viewed in the embodiment of FIGS. 15 and 17-19. The one or more juts 1592 may each comprise jut sides 1594 and 1596, which may be non-parallel in one embodiment. For example, in one embodiment, the jut sides 1594 may be substantially perpendicular or close to perpendicular to the tangential direction along the length of the latch mating element 1518, whereas the jut sides 1596 may have an angle that is that is acute, such as 45 degrees for example, relative to this length. Such a configuration may facilitate urging the latch mating element 1518 further into the housing 1530 and along the belt path 1536 in one direction but not the other, opposing direction, such as described below.

However, the latch mating element 1518 may be otherwise configured, such as with one or more ribs, notches, jags, points, curves, or voids, for example, to mate with the magnetically actuable latch 1512 in the locking position. For example, in one embodiment, the latch mating element 1518 may be configured with one or more voids 1590 shaped like or somewhat like that of the one or more protrusions 1551 of the magnetically actuable latch 1512. Thus, at least one void 1590 may receive at least one protrusion 1551 or a portion thereof, which may prevent or inhibit movement of the latch mating element 1518 along the belt path 1536 and out of the end 1540B of the belt path wall 1540 and thus the belt path 1536, such as described below.

In one embodiment, the latch mating element 1518 is deformable and may include a plastic or a rubber, for example. Such a deformable property may facilitate moving the latch mating element 1518 against the magnetically actuable latch 1512 as described below.

In another embodiment, the latch mating element 1518 comprises a penetrable material such as rubber or a soft plastic, and the magnetically actuable latch 1512 may include protrusions 1551, such as pointed teeth. These protrusions may dig into the latch mating element 1518 where the magnetically actuable latch 1512 is in the locking position and the latch mating element 1518 may thus provide resistance to a force urging movement out of the end 1540B of the belt path 1536.

Figure 10:
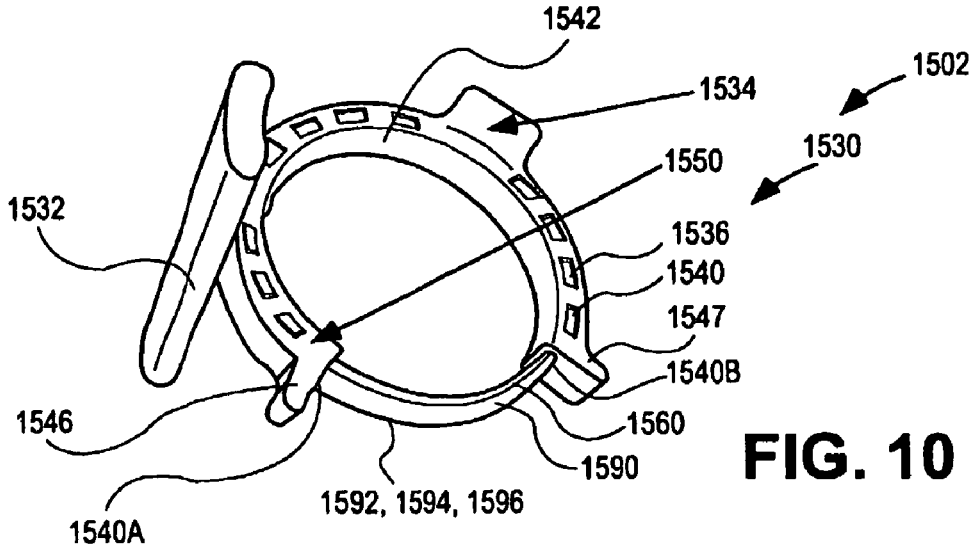
FIG. 10 illustrates a perspective view of a belt assembly, in accordance with one embodiment.
Figure 11:
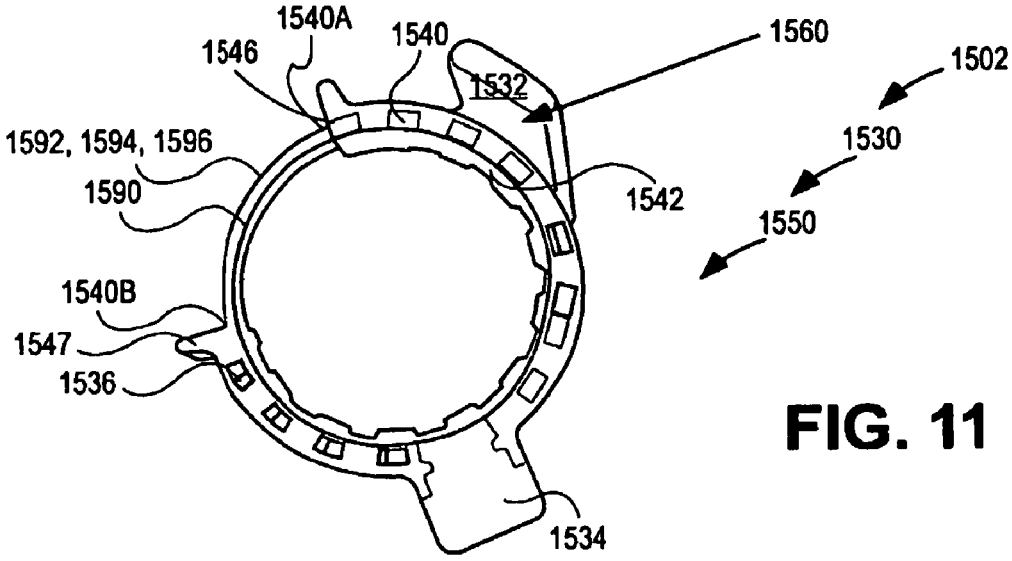
FIG. 11 illustrates a perspective view of a belt assembly, in accordance with one embodiment.

Referring to FIGS. 10 and 11, which illustrate perspective views of a belt assembly 1550 of the housing 1530 may include one or more of a locking mechanism pouch 1531, security tag chamber 1532, locking mechanism cover 1534, and belt path 1536 configured to receive a locking mechanism 1510 portion, cover the locking mechanism pouch 1531, receive the security tag 1520, cover the locking mechanism pouch 1531, and receive the security belt 1560, respectively.

The locking mechanism pouch 1531 may be shaped to receive the magnetically actuable latch 1512 and flexible element 1516 of the locking mechanism 1510. In one embodiment, the locking mechanism pouch 1531 is secured to and extends from the belt assembly 1550. The locking mechanism pouch 1531 may be integral with the belt path 1536 or other portion of the housing 1530 or otherwise secured thereto, such as by welding, fusing, gluing, snap-fit, interference fit, and/or by other securing means.

The locking mechanism pouch 1531 of the belt assembly 1550 may be configured such that the magnetically actuable latch 1512 and flexible element 1516 of the locking mechanism 1510 may be adjacently disposed therein. Thus, the base portion end 1513A of the magnetically actuable latch 1512 may be positioned near or in abutment with the flexible element 1516. With such a configuration, the movement of the magnetically actuable latch 1512 and flexible element 1516 may be restricted in one or more directions.

For example, the locking mechanism pouch 1531 may include a channel end wall 1565, channel walls 1566 and 1568, and a channel 1564 delineated by channel walls 1566 and 1568 and bounded by the channel end wall 1565. The channel walls 1566 and 1568 may include portions substantially parallel to each other, and may be positioned close to or in contact with the magnetically actuable latch 1512 at the base portion side surfaces 1513B and 1513C and at the sides of the central and latching portions 1515 and 1514, respectively, thereby restricting the movement of the magnetically actuable latch 1512 to movement along the channel 1564, which may be movement in a substantially linear direction, for example.

In various other embodiments, the magnetically actuable latch 912 may move in a rotational, combination rotational/linear direction, or any other direction or directions. In these various other embodiments, one or more of the channel 964, flexible element 916, and latch mating element 918 may be contoured, shaped, or otherwise configured to guide the magnetically actuable latch 912 in the direction or directions.

The flexible element 1516 may be positioned adjacent the channel end wall 1565 such that where the magnetically actuable latch 1512 is forced away from the locking position and against the flexible element 1516, the flexible element 1516 may compress by the force of the magnetically actuable latch 1512 and the resistant force of the channel end wall 1565. The flexible element 1516 may provide a resistant force to such compression, against such movement of the magnetically actuable latch 1512.

As described above, in each of various embodiments the magnetically actuable latch 1512 may be configured with another shape, in which case the channel 1564, and thus the channel walls 1566 and 1568, may be configured to accommodate such a magnetically actuable latch 1512 and possibly restrict the movement of the magnetically actuable latch 1512 in one or more directions. In each of these embodiments, the flexible element 1516 may be configured to fit within the channel 1564.

Thus, the flexible element 1516 of the locking mechanism 1510 may bias the magnetically actuable latch 1512 into the locking position where the teeth 1552-1556 or other one or more protrusions 1551 of the magnetically actuable latch 1512 may engage the juts 1592 of the latch mating element 1518 portion disposed in the belt path 1536 of the belt assembly 1550. Such a configuration may prevent or provide resistance to movement of the latch mating element 1518 out of the belt path 1536 and thus the security device 1502.

For example, in one embodiment, where a tooth 1552 of the magnetically actuable latch 1512 is disposed in the locking position between two juts 1592, the adjacent jut side 1594 may be substantially parallel or have a small angle relative to the tooth side 1552B. But the jut side 1594 and tooth side 1552B may be substantially perpendicular or close to perpendicular to the direction in which the latch mating element 1518 moves by via the belt path 1536 as constrained by the belt path walls 1540. Thus, where a force is applied to the latch mating element 1518 to pull it out of the belt path 1536, the latch mating element 1518 may move until the jut side 1594 and tooth side 1552B contact and exert opposing substantially or close to normal forces on each other. In such case, the latch mating element 1518 may be prevented or inhibited from being pulled out of the belt path 1536.

However, in one embodiment, such a configuration may not prevent or may provide less resistance to movement of the latch mating element 1518 into and along the belt path 1536 of the belt assembly 1550. Thus, the tooth side 1552A and adjacent jut side 1596 may be angled relative to the direction of movement of the latch mating element 1518 along the belt path 1536. Where a force is applied to the latch mating element 1518 to urge it further into and along the belt path 1536, the latch mating element 1518 may move until the jut side 1596 and tooth side 1552A contact. In such case, the jut side 1596 may urge the tooth side 1552A and thus the appended tooth 1552 and magnetically actuable latch 1512 away from the locking position, facilitating moving the latch mating element 1518 along the belt path.

Additionally, when the jut side 1596 and tooth side 1552A contact, these elements may exert much lesser opposing normal forces than those of the jut side 1594 and tooth side 1552B, and if the outer material of the latch mating element 1518 is deformable as discussed herein, the latch mating element 1518 may be more easily moved. Movement may be made by a force greater than any normal force, plus other forces such as discussed above.

This force to move more of the latch mating element 1518 of the security belt 1560 into and along the belt path 1536 may be lower, and may be much lower, than the force to move the latch mating element 1518 out of the belt path 1536. Thus, for example, this lower force may be manageably exerted in one embodiment by a person, such that the person may tighten the latch mating element 1518 and thus constrict the belt path wall 1540 of the belt assembly 1550 around a bottle neck. In embodiments where the magnetically actuable latch 1512 has multiple protrusions 1551 and the latch mating element 1518 has multiple juts 1592 or other one or more protrusions, the opposing forces caused by all protrusions 1551 and juts 1592 in contact may need to be overcome. This force may still be such that a person can manageably force the latch mating element 1518 further into and along the belt path 1536.

Figure 13:
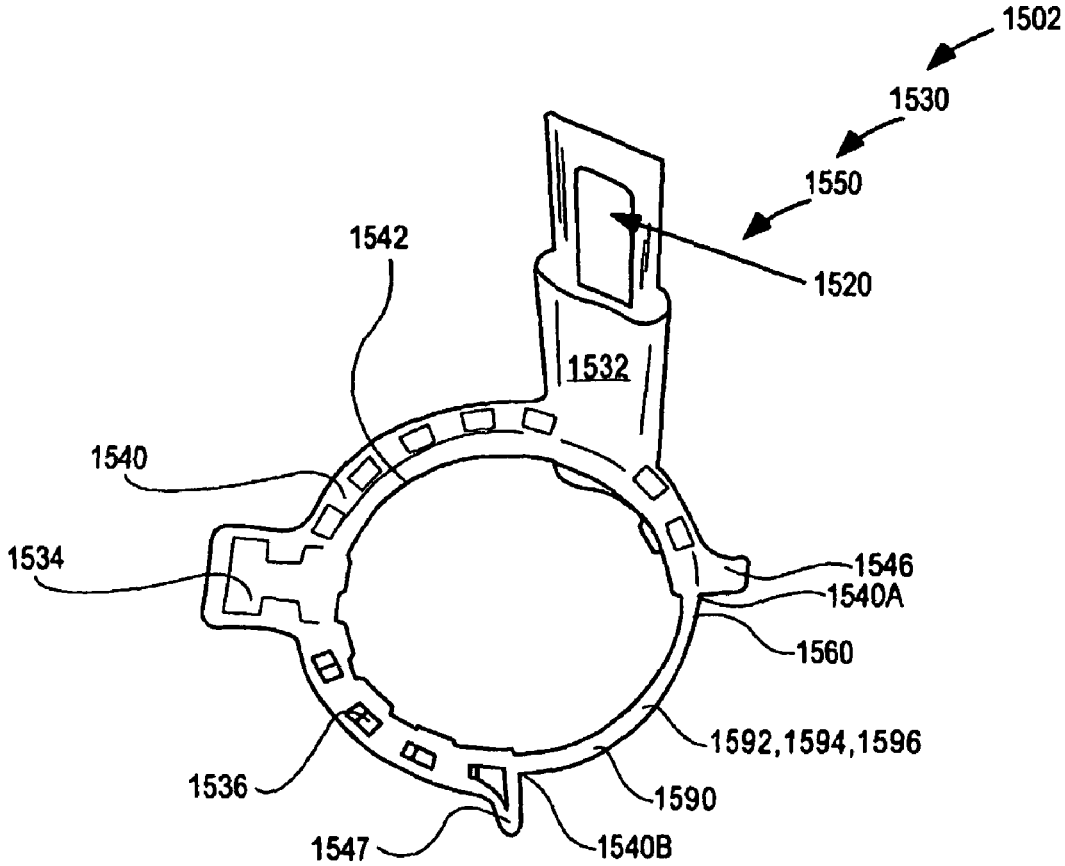
FIG. 13 illustrates a perspective view of a portion of a belt assembly, in accordance with one embodiment.

FIG. 13 illustrates a perspective view of a portion of a belt assembly 1550 showing the security tag 1520. Referring to FIG. 13 along with FIGS. 10-12, the security tag chamber 1532 of the housing may be shaped to enclose a security tag, such as the security tag 1520. In one embodiment, the security tag 1520 is a slender elongated member, and the security tag chamber 1532 has perimeter walls that delineate an internal void shaped to closely hold the security tag 1520. However, in various other embodiments, the security tag chamber 1532 may be variously configured to enclose or otherwise secure the security tag 1520 or a security tag of any other shape.

The security tag chamber 1532 may be secured to the belt path wall 1540 or otherwise with the rest of the housing 1530, such as by any way described above with respect to the locking mechanism pouch 1531 above. In one embodiment, the security tag chamber 1532 may be slidably affixed to the belt path wall 1540. As secured, the security tag chamber 1532 may prevent or increase the difficulty of removing the security tag 1520 from the housing 1530 and thus any bottle that may be secured to the bottle security device 1502.

The locking mechanism cover 1534, such as shown in FIGS. 10-11, may comprise a structure configured to be positioned on the locking mechanism pouch 1531 and over the flexible element 1516 and at least a portion, such as an exposed portion, of the magnetically actuable latch 1512. The locking mechanism cover 1534 may be secured to the belt assembly 1550 such as by any way described above with respect to locking mechanism pouch 1531 or otherwise herein. As secured, the locking mechanism cover 1534 may prevent or increase the difficulty of removing the magnetically actuable latch 1512 from the housing 1530.

In one embodiment, the locking mechanism pouch 1531 and the locking mechanism cover 1534 may, as secured, be called a locking mechanism chamber. The locking mechanism chamber may at least partially enclose and thereby secure the magnetically actuable latch 1512 and the flexible element 1516 of the locking mechanism 1510 to the bottle security device 1502.

Referring to FIGS. 10-14, the belt path 1536 may comprise a belt path wall 1540 and a belt path 1536 delineated by the belt path wall 1540. The belt path wall 1540 may be configured with a shape and material or materials allowing the belt path wall 1540 to constrict around a bottle neck or other article to thereby secure the bottle to the housing 1530 and thus the bottle security device 1502. In one embodiment, the belt path wall 1540 may include a portion of the security belt 1560.

In one embodiment, the portion of the belt path wall 1540 that may contact a bottle secured by the bottle security device 1502 is the bottle securing surface 1542. In an embodiment, the bottle securing surface 1542 may have at least a portion of an annulus or another curved shape that may conform to the bottle belt channel 1568 and to tighten the bottle hat 1570 around a circular or otherwise curved shape of a bottle neck when constricted. In one embodiment, the bottle securing surface 1542 may constrict directly around the bottle neck, and the bottle hat 1570 may not be used.

In one embodiment, the belt path wall 1540 may comprise a plastic or other material or materials that are bendable, extendable, deformable, or otherwise capable of such constriction.

In one embodiment, the belt path wall 1540 comprises a material capable of such and constriction and which is at least somewhat resilient. Such a configuration may allow the belt path wall 1540 to return to its unconstricted shape or a similar shape such that the bottle security device may be reused.

The belt path wall 1540 may also be shaped to receive the security belt 1560 described herein. In one embodiment, the belt path wall 1540 delineates an annular or otherwise curved belt path 1536 of a substantially uniform thickness. This belt path 1536 may have substantially the same curve as the exterior of the belt path wall 1540 in one embodiment. However, in other embodiments, the belt path wall 1540 may have various thicknesses and alignments. Such varying thicknesses and alignments may be accomplished without changing the shape of the bottle securing surface 1542 by varying the configuration of one or more other surfaces of the belt path wall 1540.

In one embodiment, the belt path wall 1540 may be configured to be constricted around the bottle hat 1570, which may surround at least a portion of the bottle and may thus constrict around the bottle. Such a configuration may thus secure the bottle to the bottle hat 1570 and belt path wall 1540, and thus to the bottle security device 1502. The bottle securing surface 1542 may be shaped such that it can be partially disposed in the belt receiving channel or channels (e.g., 1586 of the leg 1581) of the one or more legs 1581-1583. In one embodiment, the bottle securing surface 1542 includes one or more ridges 1544 configured to extend into the one or more grooves (e.g., 1590 of the leg 1581) of the legs 1581-1583, which may align the bottle securing surface 1542 with the bottle hat 1570 when disposed around it.

The belt path wall 1540 may include two ends 1540A and 1540B. In one embodiment, handles 1546 and 1547 extend from the two ends 1540A and 1540B, and may facilitate constricting the belt.

The security belt 1560 may be shaped such that it may be fed into and along the belt path. In one embodiment, at least part of the security belt 1560 is an elongated element that may be curved in shape. The security belt 1560 may be, in one embodiment, shaped with a curve that is the same or similar to that of the belt path 1536, which may facilitate moving it along the belt path 1536. However, the security belt 1560 may be otherwise shaped.

In various embodiments, security belt 1560 may comprise one or more materials in any configuration. For example, in one embodiment, the security belt 1560 includes a plastic outer layer and metal inner layer. The metal and plastic components may separable or inseparable. For example, the metal and plastic components may be bonded, press-fit, co-molded, inserted, and/or coated. The metal portion may strengthen the security belt 1560 and prevent or inhibit breaking or otherwise separating portions of the security belt 1560, and thus prevent or inhibit unlocking the bottle security device 1502 from any bottle to which it may be secured. The metal may be beaded, stranded, flat-wire, partially cylindrical, or may be formed in any suitable way to reinforce the security belt 1560 and possibly also to allow or provide flexibility in the security belt 1560.

The security belt 1560 may be integral with or otherwise attached to the belt assembly 1550. For example, in one embodiment, the security belt 1560 is integral with or otherwise attached to the belt assembly 1550 within the belt path 1536 to the belt path wall 1540 at one of the ends of the security belt 1560. In this embodiment, the security belt 1560 may extend, from its attached end, out the end 1540A of the belt path 1536 and then back into the belt path 1536 at the end 1540A. Thus, the security belt 1560 may branch the two ends 1540A and 1540B such that the belt path wall 1540 and security belt 1560 may continuously surround a portion, such as the neck, of a bottle. However, in one embodiment, the two ends 1540A and 1540B may be positioned at any points along the circumference of the belt assembly 1550. For example, the end 1540A may comprise or be adjacent a side of the locking mechanism pouch 1531, and 1540A may be located at or near or at an opposite side.

In one embodiment, the handles 1546 and 1547 may be engaged and urged toward each other to move the attached security belt 1560 farther into and along the belt path 1536 to constrict the belt path wall 1540 about a bottle neck or other portion. As described below, when moving in this direction, portions of the latch mating element 1518 that may include the security belt 1560 may contact but move past the magnetically actuable latch 1512 without significant resistance. However, movement in the opposite direction may be prevented or met with greater resistance such that the belt path wall 1540 may remain in the constricted position after the handles 1546 and 1547 have been released. Thus, the security belt 1560 and belt path wall 1540 may cooperate to fixedly secure the bottle mouth and portion of the neck to the bottle security device 1502. In one embodiment, forcibly removing the such a configured bottle security device 1502 may break the bottle, since the force to remove the bottle security device 1502 may be greater than the force to break the bottle, such as where the bottle is formed of glass.

FIGS. 15-19 illustrate a perspective, top, side, side, and exploded view of a bottle security device 1602, in accordance with one embodiment. The security device 1602 may be similarly configured with a housing 1630 but may include a security tag chamber 1632 that may be disposed sideways in the belt assembly 1650 relative to the positioning of the security tag chamber 1532 in the belt assembly 1550 described above. The belt assembly 1650 may include a bottom housing 1650A and top housing 1650B that may welded, fused, snap-fit or otherwise secured together to provide resistance to or prevent at attempt to open it.

Figure 32:
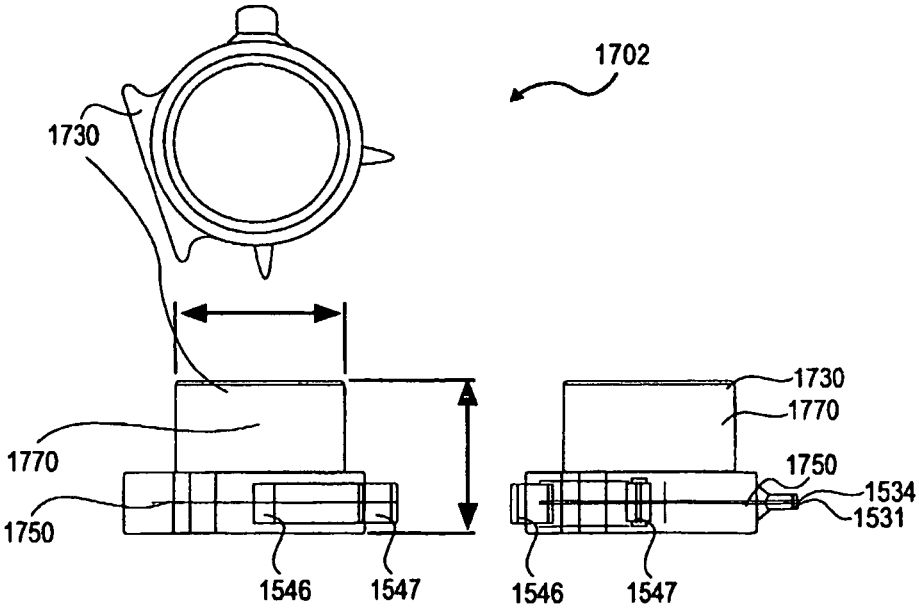
FIG. 32 illustrates a top, side, and side view of a bottle security device, in accordance with one embodiment.
Figure 29:
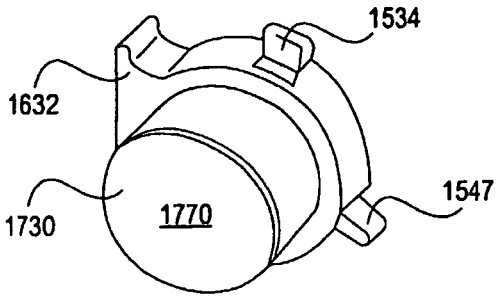
FIG. 29 illustrates a perspective view of a bottle security device, in accordance with one embodiment.
Figure 31:
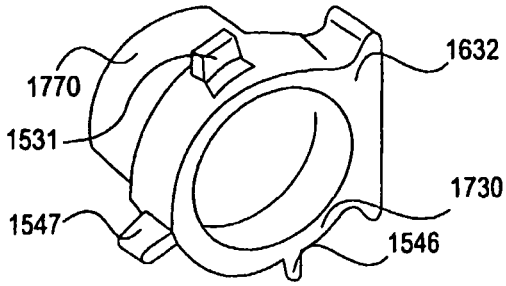
FIG. 31 illustrates a perspective view of a bottle security device, in accordance with one embodiment.

FIGS. 20-31 illustrate perspective views and FIG. 32 illustrates a top, front, and side view of a bottle security device 1702 or portion thereof, in accordance with one embodiment. The security device 1702 may have similar elements to that of the bottle hat 1570 plus either the belt assembly 1550 or 1650 as described above. However, the bottle security device 1702 may have a housing 1730 comprising an integral belt assembly 1750 and bottle hat 1770 that may be affixed by welding, fusing, gluing, snap-fit, interference fit, and/or by other securing means, for example.

Additionally, the belt assembly 1750 and security belt 1760 may have an alternative configuration. In one embodiment, instead of a belt path wall, such as the belt path wall 1540 having a belt contacting surface 1542 as described above, the security belt 1760 may comprise the inner wall 1740A of the belt assembly 1750. In one embodiment, the security belt 1760 is configured as a coil that may be integral with or otherwise affixed to the belt assembly 1750 at one or more locations. For example, in one embodiment, portions of the security belt 1760 at or near its ends 1760A and 1760B may be integral with or otherwise affixed to a base 1747 and a wheel (not shown), respectively, of the belt assembly 1750. The wheel may be disposed between the security belt 1760 and the outer wall 1740B. The ends 1760A and 1760B may overlap and may coil, when constricted around at least part of a bottle mouth and neck or other like-shaped element. The coiling may lessen the diameter or other cross-sectional area of the space within the coil to thereby constrict the security belt 1760.

Figure 33:
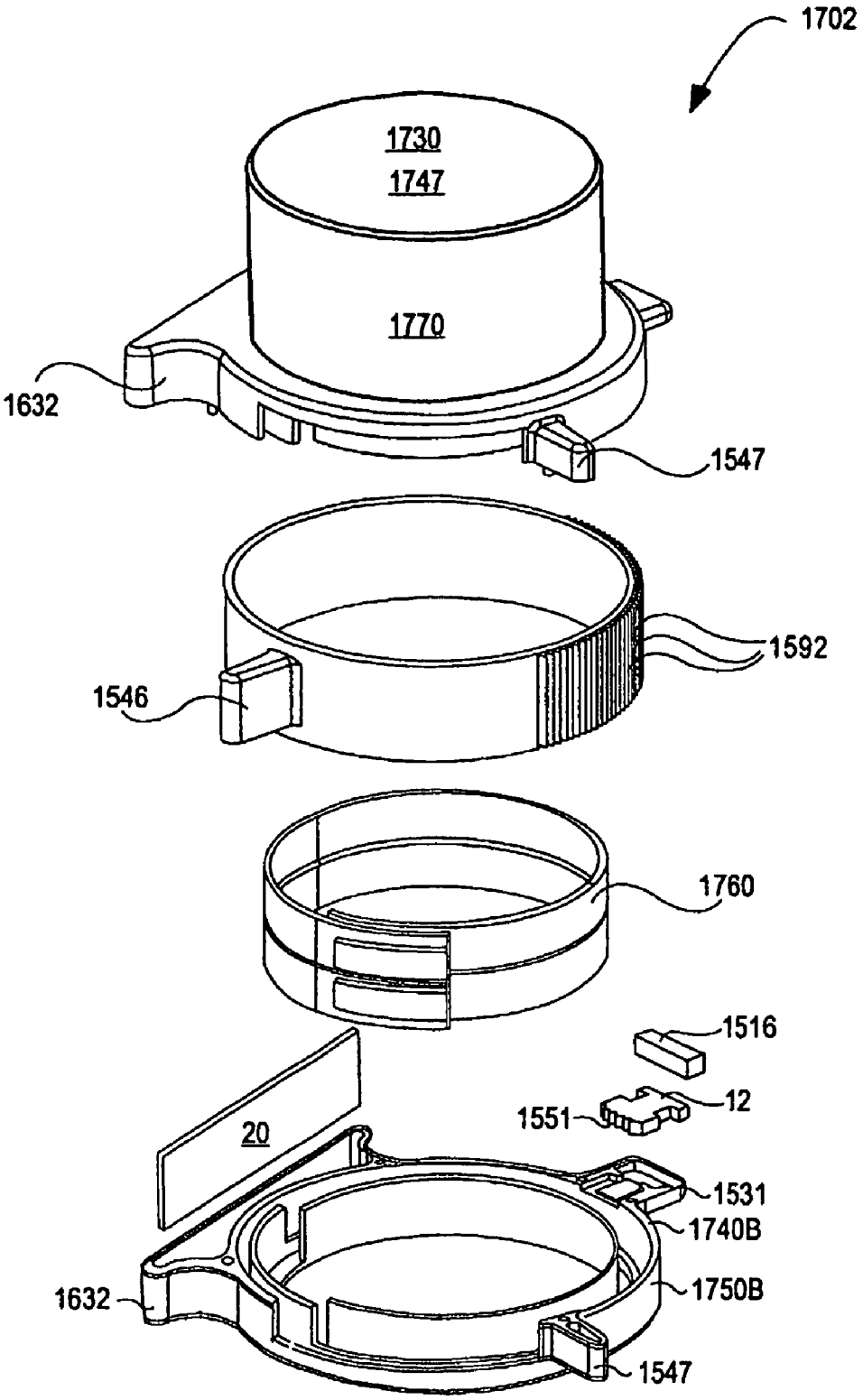
FIG. 33 illustrates an exploded view of a bottle security device, in accordance with one embodiment.

FIG. 33 illustrates an exploded view of the bottle security device 1702, in accordance with one embodiment. As shown, a wheel 1745 may include a latch mating element 1518 comprising juts 1592 that may engage the protrusions 1551 of the latch mating element 12 to lock the bottle security device 1702, such as described herein.

In various embodiments, a cabled security device system may include one of the bottle security devices 1502, 1602, or 1702 described herein with respect to FIGS. 2-33 and a detacher, such as the detacher 40 described herein with respect to FIG. 1. For example, with respect to the cabled security device 1502 embodiment, where the detacher 40 is placed near the magnetically actuable latch 1512 of the cabled security device 1502 such that the flexible element 1516 is positioned between the detacher 40 and magnetically actuable latch 1512, the detacher 40 may magnetically force the magnetically actuable latch 1512 out of the locking position and against the flexible element 1516. If the magnetic force is greater than the compressive force of the flexible element 1516 and any other forces resisting such movement of the magnetically actuable latch 1512, the magnetically actuable latch 1512 may move out of the locking position. In such case, the security belt 1560 may not be blocked from moving completely out of belt path 1536 such as described herein. As such, the belt path wall 1540 may tend to return to its unconstricted shape such that its ends 1540A and 1540B may move apart and the security belt may thereby move out of the belt path 1536. This may unlock the bottle from the bottle security device 1502, allowing the bottle to be freely removed therefrom.

In various embodiments, because no part of each of the security devices 1502 and 1602 may be broken to unlock it, that security device may be reusable. In another embodiment, either or both of the security devices 1502 and 1602 may employ magnetically actuable latches that are for one-time use or are resettable.

In an embodiment, a bottle cover security device that may be an accessory for an EAS bottle clamp security device, may provide a security device that carries an EAS component that may be utilized to prevent the unauthorized opening of a typical wine or liquor bottle. The bottle cover security device may prevent a shoplifter from opening the bottle of liquor and pouring the contents into an untagged container and then leaving the store.

One example of an anti-theft device for bottles may be disclosed in U.S. Pat. No. 5,602,530. The device disclosed in this patent may include an outer socket that can be moved in relation to an inner socket between two end positions, with one of the end positions being a locking position. Pluralities of retainers may be distributed about the periphery of the inner surface of the outer socket. The retainers may extend into the inner socket when the outer socket is in the locked end position. These retainers may engage the bottle beneath the bead that is typically disposed on the neck of a bottle. The retainers may thus prevent the removal of the device from the neck of the bottle until biased outwardly by a magnetic key. This product may be too expensive and may have too long of a neck.

In an embodiment, a bottle cover security device may include an EAS tag-carrying locking strap and a magnetic mechanism. In an embodiment, the bottle cover security device may be capable of holding an EAS tag-carrying locking strap and a magnetic mechanism for commonly-sized beer, wine, and liquor bottles. In an embodiment, the bottle cover security device may be produced in large quantities relatively inexpensively with one-piece molded plastic members.

In another embodiment, a bottle cover security device may be capable of being secured to bottles of various shapes and sizes. In an embodiment, a bottle cover security device may be inexpensive and easy to both make and use and may be easily and repeatedly used by retail shop personnel. In an embodiment, a bottle cover security device may be molded of rugged plastic that is very difficult to break, rip, or otherwise disable. In an embodiment, a bottle security device may cooperate with the bead or other structures commonly present on the neck of a bottle to lock itself to the neck of a bottle. In an embodiment, a bottle cover security device that locks on the neck of a bottle with a EAS tag-carrying locking strap to it with a magnetic mechanism may prevent the contents of the bottle from being removed from the bottle without removing the bottle security device or breaking the bottle. In an embodiment, a bottle security device having locking members may not be easily picked by a shoplifter. In an embodiment, a bottle cover security device may include a ring that functions to prevent a shoplifter from easily prying the device off of the neck of a bottle. In an embodiment, a bottle cover security device may be of simple construction, which may operate in a simple, effective, and inexpensive manner In an embodiment, a bottle cover security device may include a bottle cover security device capable of holding a EAS tag-carrying locking strap to it with a magnetic mechanism to secure the top neck of a bottle, a cover with three legs, a channel around the three legs to hold an EAS tag-carrying locking strap to it, and a magnetic mechanism. In an embodiment, a cover member may be adapted to fit around the neck of a bottle and have an EAS tag-carrying locking strap and a magnetic mechanism to go around the cover and lock the neck of the bottle.

Embodiments described above with respect to the bottle cover may, in various embodiments, correspond to embodiments of a bottle belt security device and a bottle hat security device.

In an embodiment, a bottle cover security device according may be depicted in the accompanying drawings. In an embodiment, a bottle cover security device may include three legs members with a channel around the three legs to hold an EAS tag-carrying locking strap that may have a magnetic mechanism, which may cooperate to lock on the neck of a bottle. In an embodiment, a bottle cover security device may remain locked on the bottle neck until a user unlocks it and the magnetic mechanism. In an embodiment, a bottle cover security device may be depicted in the accompanying drawings and may includes three (3) legs members with a channel around the three legs to hold an EAS tag (Bottle Clamp Tag) and to cooperate to lock on the neck of a bottle. In an embodiment, a bottle cover security device may remain locked on a bottle neck until a user unlocks it and the magnetic mechanism with a detachable magnet.

In an embodiment, a bottle belt security device may be capable of holding an EAS tag-carrying locking strap to it with a magnetic mechanism with an accessory (bottle cover security device) to secure the top neck of a bottle a belt with three legs a channel around the three legs to hold an EAS tag-carrying locking strap to it with a magnetic mechanism. In an embodiment, a bottle belt security device may include a belt member adapted to fit around the neck of the bottle, and for an EAS tag-carrying locking strap to it with a magnetic mechanism to go around this belt and lock the neck of the bottle.

In an embodiment, a bottle belt security device may include an EAS tag for carrying a locking strap to it with a magnetic mechanism and to cooperate to lock on the neck of a typical bottle. In an embodiment, a bottle belt security device may remain locked on a bottle neck until a user unlocks a device with a detachable magnet.

In an embodiment, a bottle hat security device may be capable of holding an EAS tag with a magnetic mechanism to secure the top neck of a bottle. In an embodiment, a bottle hat security device may include a top and bottom housing that hold an EAS label, an inner member (belt) and an outer member (handle) that cooperates to lock the bottle security device on the neck of a bottle with a mechanism of a latch with foam. The inner member (handle) may further include teeth that rotate inside the top and bottom housing on a channel that go thru the mechanism that has a latch with teeth hold by foam.

In an embodiment, a bottle hat security device may be capable of holding an EAS tag with a magnetic mechanism to secure the top neck of a bottle. In an embodiment, a bottle hat security device may include a top and bottom housing that hold an EAS label, an inner member (belt), and an outer member (handle) that cooperate to lock the bottle security device on the neck of a bottle with a mechanism of a latch with foam. The inner member (handle) may further include teeth that rotate inside the top and bottom housing on a channel that go thru the mechanism that has a latch with teeth hold by foam.

While certain features of the embodiments have been illustrated as described herein, many modifications, substitutions, changes and equivalents will now occur to those skilled in the art. It is, therefore, to be understood that the appended claims are intended to cover all such modifications and changes as fall within the scope of the embodiments.

The invention claimed is:

1. A security device for a bottle, comprising:

a housing providing an opening for receiving the neck of a bottle;

a belt channel defined by the housing, the belt channel having two ends which may be urged toward each other;

a belt slidably disposed in the belt channel and extending between the two ends of the belt channel, wherein the bottle is secured to the housing by constricting the belt channel around the neck of a bottle to urge the belt into the belt channel; and a magnetically actuable locking mechanism, wherein the magnetically actuable locking mechanism and belt are secured to the housing.

2. The security device of claim 1, wherein the magnetically actuable locking mechanism comprises a magnetically actuable latch, a flexible element, and a latch mating element.

3. The security device of claim 2, wherein the flexible element and the magnetically actuable latch are combined as a single piece.

4. The security device of claim 2, wherein the magnetically actuable latch and flexible element are at least partially disposed in the belt channel.

5. The security device of claim 2, wherein the belt comprises the latch mating element.

6. The security device of claim 2, wherein the latch mating element comprises at least one void.

7. The security device of claim 6, wherein the flexible element is positioned adjacent the magnetically actuable latch and biases the magnetically actuable latch toward a locking position in which at least part of the magnetically actuable latch extends into the void.

8. The security device of claim 2, wherein the latch mating element comprises at least one jut.

9. The security device of claim 8, wherein the at least one jut mates with the magnetically actuable latch when the magnetically actuable latch is in a locking position.

10. The security device of claim 2, wherein the magnetically actuable latch includes at least one protrusion to mate with the latch mating element.

11. The security device of claim 10, wherein the latch mating element comprises at least one void, and wherein the at least one protrusion is to mate with the latch mating element by mating with the at least one void.

12. The security device of claim 2, wherein the magnetically actuable latch is positioned between the flexible element and the latch mating element.

13. The security device of claim 1, further comprising a security tag.

14. The security device of claim 13, wherein the security tag is enclosed within the housing.

15. The security device of claim 13, wherein the security device is reusable.

16. The security device of claim 13, wherein the security device is for onetime use.

17. The security device of claim 13, wherein the security device is resettable.

18. The security device of claim 2, wherein the latch mating element comprises a penetrable material.

19. The security device of claim 7, wherein when the magnetically actuable latch is in the locking position, resistance is provided against the moving of the belt in one direction relative to an opposing direction.

20. The security device of claim 1, further comprising a bottle hat to receive a mouth of the bottle and to be secured to the housing.

21. The security device of claim 20, wherein the bottle hat is integral with the housing.

22. The security device of claim 20, wherein the bottle hat and housing are separate elements.

23. The locking mechanism of claim 2, wherein the magnetically actuable latch may be moved away from the locking position by magnetic force.

24. The locking mechanism of claim 23, wherein the magnetically actuable latch may be moved in a substantially linear direction.

25. The locking mechanism of claim 23, wherein the magnetically actuable latch may be moved in a substantially rotational direction.

26. The locking mechanism of claim 23, wherein the magnetically actuable latch may be moved in a combination of a rotational and linear direction.

27. A security device for a bottle, comprising:

a magnetically actuable locking mechanism;

a security tag;

a belt; and a housing, the magnetically actuable locking mechanism, security tag, and belt secured to the housing wherein the housing comprises a belt path wall having two ends, the bottle being secured to the housing by urging the two ends toward each other to constrict the belt path wall around a neck of the bottle.

28. The security device of claim 27, wherein the two ends each have a handle extending therefrom, and wherein the two handles may be urged toward each other to constrict the belt path.

29. The security device of claim 27, wherein at least a portion of the belt moves along the belt path when the two handles are urged toward each other.

30. The security device of claim 27, wherein the housing comprises a security tag chamber, the security tag chamber enclosing the security tag.

31. The security device of claim 27, wherein the housing comprises a locking mechanism pouch, the locking mechanism pouch enclosing the locking mechanism.

32. The security device of claim 27, further comprising a bottle hat to receive a mouth of the bottle and to be secured to the housing.

33. The security device of claim 32, wherein the bottle hat is integral with the housing.

34. The security device of claim 32, wherein the bottle hat and housing are separate elements.

35. A security device system for a bottle, comprising:

a security device comprising:

a housing, a belt secured to the housing wherein the housing comprises a belt path wall having two ends, the bottle being secured to the housing by urging the two ends toward each other to constrict the belt path wall around a neck of the bottle, and a magnetically actuable locking mechanism disposed in the housing; and a detacher to unlock the security device, the detacher comprising a magnet.

* * * * *